US011738231B2

(12) United States Patent
Aronson et al.

(10) Patent No.: US 11,738,231 B2
(45) Date of Patent: Aug. 29, 2023

(54) PILATES EXERCISE MACHINE

(71) Applicant: RockIt Body Pilates, LLC, Studio City, CA (US)

(72) Inventors: Judith Aronson, Manhattan Beach, CA (US); Alan Crawford, Glendale, CA (US)

( * ) Notice: Subject to any disclaimer, the term of this patent is extended or adjusted under 35 U.S.C. 154(b) by 74 days.

(21) Appl. No.: 17/463,025

(22) Filed: Aug. 31, 2021

(65) Prior Publication Data

US 2021/0394005 A1 Dec. 23, 2021

Related U.S. Application Data

(63) Continuation of application No. 16/399,976, filed on Apr. 30, 2019, now Pat. No. 11,103,737, which is a (Continued)

(51) Int. Cl.
*A63B 21/02* (2006.01)
*A63B 21/04* (2006.01)
(Continued)

(52) U.S. Cl.
CPC ..... *A63B 21/025* (2013.01); *A63B 21/00065* (2013.01); *A63B 21/0407* (2013.01); *A63B 21/4034* (2015.10); *A63B 21/4035* (2015.10); *A63B 21/4045* (2015.10); *A63B 22/0056* (2013.01); *A63B 22/0089* (2013.01); *A63B 21/4033* (2015.10); *A63B 21/4039* (2015.10); *A63B 21/4043* (2015.10);
(Continued)

(58) Field of Classification Search
CPC .. A63B 22/0076; A63B 22/0087–0089; A63B 22/02–0557; A63B 22/04–0442; A63B 22/20–203; A63B 22/4034; A63B 21/025; A63B 21/00065; A63B 21/0407; A63B 21/4034; A63B 21/4035; A63B 21/4045; A63B 22/0056; A63B 22/0089; A63B 21/4033; A63B 21/4039; A63B 21/4043; A63B 23/03516; A63B 2022/0033; A63B 2022/0038
See application file for complete search history.

(56) References Cited

U.S. PATENT DOCUMENTS 1,621,477 A 3/1927 Pilates
5,002,271 A * 3/1991 Gonzales ..... A63B 23/0494 482/130
(Continued)

*Primary Examiner* — Jennifer Robertson
(74) *Attorney, Agent, or Firm* — Cislo & Thomas, LLP

(57) ABSTRACT

In one aspect of the present exercise machine, an assembly is attached to the end of a reformer, where the assembly comprises a seat mechanism and a pedal mechanism. The seat mechanism has a seat, a bracket supporting the seat, and a height adjustment system, where activation of the height adjustment system permits selective adjustment and locking of the height of the seat and the bracket by restricting travel of the seat and bracket to a slanted path that is slanted relative to the vertical. The pedal mechanism has an axle, a first pedal arm with a first pedal, and a second pedal arm with a second pedal. The pedal mechanism is located directly beneath the seat when the seat mechanism is in a lowest position and partially exposed in a higher position.

1 Claim, 29 Drawing Sheets

Related U.S. Application Data continuation of application No. 16/102,609, filed on Aug. 13, 2018, now Pat. No. 10,272,281, which is a continuation of application No. 15/213,258, filed on Jul. 18, 2016, now Pat. No. 10,046,193.

(60) Provisional application No. 62/194,128, filed on Jul. 17, 2015.

(51) Int. Cl.
*A63B 21/00* (2006.01)
*A63B 22/00* (2006.01)
*A63B 23/035* (2006.01)

(52) U.S. Cl.
CPC . *A63B 23/03516* (2013.01); *A63B 2022/0033* (2013.01); *A63B 2022/0038* (2013.01)

(56) References Cited

U.S. PATENT DOCUMENTS 5,110,122 A 5/1992 Moore et al.
5,607,381 A 3/1997 Endelman
5,653,670 A 8/1997 Endelman
5,935,049 A 8/1999 Hamm
5,961,430 A 10/1999 Zuckerman et al.
6,371,895 B1 4/2002 Endelman et al.
6,471,624 B1 10/2002 Voris
6,726,608 B1 4/2004 Hsu
7,172,532 B2 2/2007 Baker
7,288,053 B2 10/2007 Endelman et al.
7,384,381 B2 6/2008 Webber et al.
7,465,261 B2 12/2008 Barnard et al.
7,803,095 B1 9/2010 LaGree
7,857,735 B2 12/2010 Merrithew et al.
7,871,358 B2 1/2011 Graham
7,967,736 B2 6/2011 D'Silva et al.
8,157,714 B2 4/2012 Mayr
8,500,614 B2 8/2013 Rooks
8,602,953 B2 12/2013 Jordan
8,641,585 B2 2/2014 LaGree
10,046,193 B1 8/2018 Aronson et al.
10,272,281 B2 4/2019 Aronson et al.
2002/0137607 A1* 9/2002 Endelman ..... A63B 21/04 482/123
2003/0078143 A1* 4/2003 Breibart ..... A63B 21/00072 482/130
2003/0119635 A1 6/2003 Arbuckle et al.
2004/0138034 A1* 7/2004 Endelman ..... A63B 22/0056 482/121
2007/0037677 A1* 2/2007 Splane, Jr. ..... A63B 21/4047 482/121
2008/0171643 A1 7/2008 Baudhuin
2008/0248935 A1 10/2008 Solow et al.
2009/0048078 A1 2/2009 Marcantonio
2009/0108648 A1 4/2009 Biggs et al.
2009/0227434 A1* 9/2009 Baudhuin ..... A63B 22/0056 482/130
2009/0264266 A1* 10/2009 Solow ..... A63B 21/023 482/130
2011/0152032 A1 6/2011 Barnett
2012/0202661 A1* 8/2012 Jordan ..... A63B 21/0428 482/142
2013/0017935 A1 1/2013 Endelman et al.
2013/0331243 A1* 12/2013 Walkama ..... A47C 9/002 482/130
2014/0100089 A1 4/2014 Kermath et al.
2014/0141948 A1 5/2014 Aronson et al.
2015/0141218 A1* 5/2015 Magrella ..... A63B 21/04 482/130

* cited by examiner

FIG. 29A
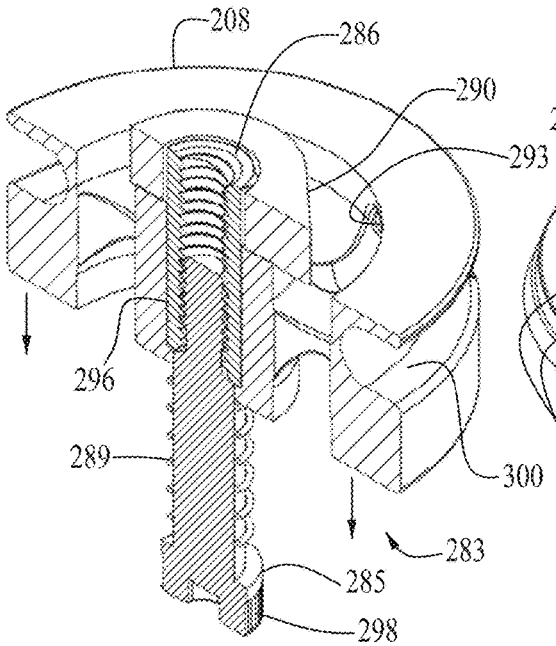
FIG. 29B
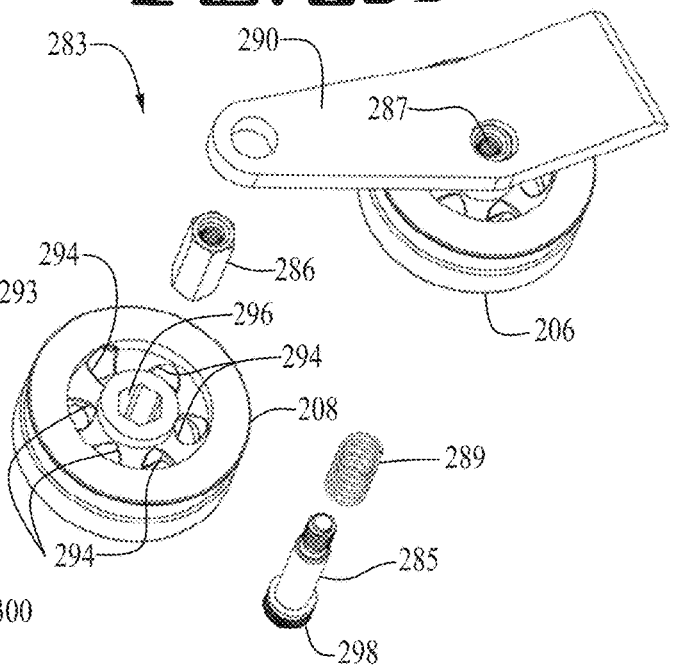
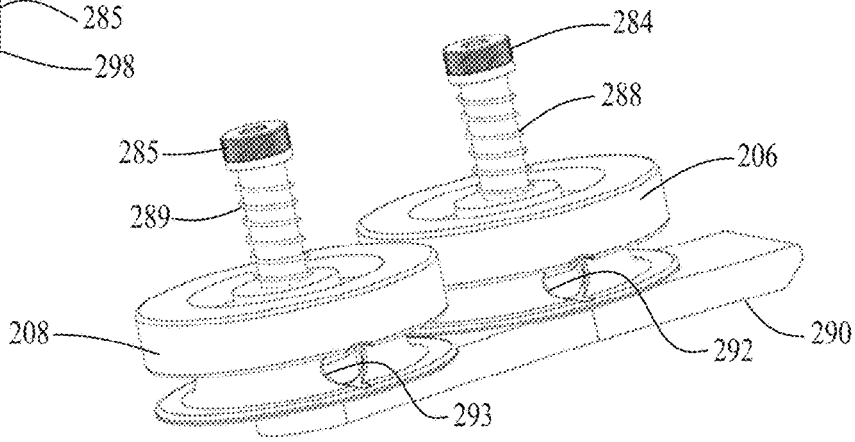
FIG. 29C

PILATES EXERCISE MACHINE

CROSS-REFERENCES TO RELATED APPLICATION

This application is a continuation of U.S. patent application Ser. No. 16/399,976, filed Apr. 30, 2019 (now U.S. Pat. No. 11,103,737), which is a continuation of U.S. patent application Ser. No. 16/102,609 filed Aug. 13, 2018 (now U.S. Pat. No. 10,272,281), which is a continuation of U.S. patent application Ser. No. 15/213,258, filed Jul. 18, 2016 (now U.S. Pat. No. 10,046,193), which claims the benefit of U.S. Provisional Application Ser. No. 62/194,128, filed Jul. 17, 2015 and entitled "Pilates Exercise Machine," which applications are incorporated in their entirety here by this reference.

TECHNICAL FIELD

The disclosure relates generally to the field of exercise equipment in which a movable carriage is moved against a resistance force to exercise one or more muscles of the body. Such devices are commonly referred to as reformers.

BACKGROUND

Reformers are a type of exercise machine originated by Joseph Pilates. A traditional reformer can have a frame supporting two parallel tracks along which a wheeled carriage can travel. Springs or other resistance members can be used to a resiliently bias the carriage towards one end of the frame. A user typically sits or lies on the carriage and pushes against a foot bar to move the carriage away from the foot bar. Alternatively, the user can grasp the ends of a pair of ropes or straps that pass through pulleys on the frame and are attached to the carriage to move the carriage along the tracks.

US Patent Application Publication US 2014/0141948 A1 (the '948 Publication) to the inventor of the present exercise device, Judith Aronson, discloses a Pilates reformer. This application discloses a reformer with a seat that can be elevated. However, an improved means for elevating a seat is required. Further, the '948 Publication fails to provide a solution to changing the rope length and finely adjusting comparative rope length to compensate for stretching in one of a rope pair. What is needed, is an exercise machine that is easy to use, by providing mechanisms that allow the user to easily change the machine's configuration as the user moves seamlessly from one exercise to another.

SUMMARY

In one aspect of the present exercise machine, an assembly is attached to the end of a reformer, where the assembly comprises a seat mechanism and a pedal mechanism. The seat mechanism has a seat, a bracket supporting the seat, and a height adjustment system, where activation of the height adjustment system permits selective adjustment and locking of the height of the seat and the bracket by restricting travel of the seat and bracket to a slanted path that is slanted relative to the vertical. The pedal mechanism has an axle, a first pedal arm with a first pedal, and a second pedal arm with a second pedal, where the first pedal arm and the second pedal arm extending from and rotating about the axle. The pedal mechanism is located directly beneath the seat when the seat mechanism is in a lowest position. And, the seat is positioned at least partially behind the pedal mechanism so that at least the first pedal and the second pedal extend beyond the seat when the seat mechanism is in a second position that is higher than the lowest position.

BRIEF DESCRIPTION OF THE SEVERAL VIEWS OF THE DRAWINGS

FIG. 16 is a partial bottom-back perspective, showing the seat and pedal mechanism, with the seat in the raised configuration;

FIG. 26 is a plan view of the rope equalizing mechanism, shown in isolation from the carriage and the remainder of the exercise device;

FIG. 29A is a perspective cross-sectional view of the adjustment sheave;

FIG. 29B is an exploded perspective view of the adjustment sheave assembly;

FIG. 29C is a perspective view of the adjustment sheave assembly;

DETAILED DESCRIPTION

Figure 1:
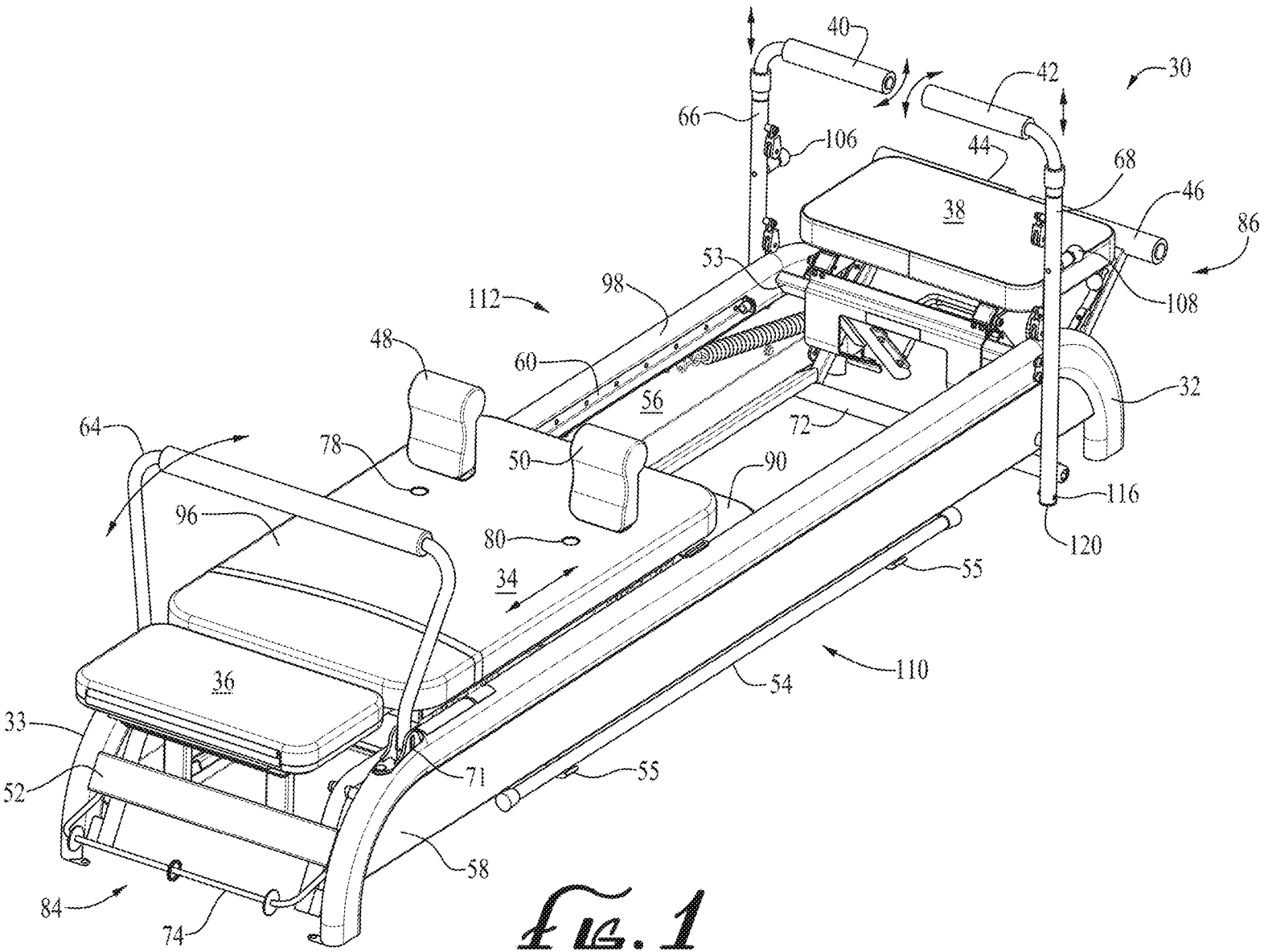
FIG. 1 is a top-front perspective view of the present exercise device, showing the seat in the lowered configuration.
Figure 2:
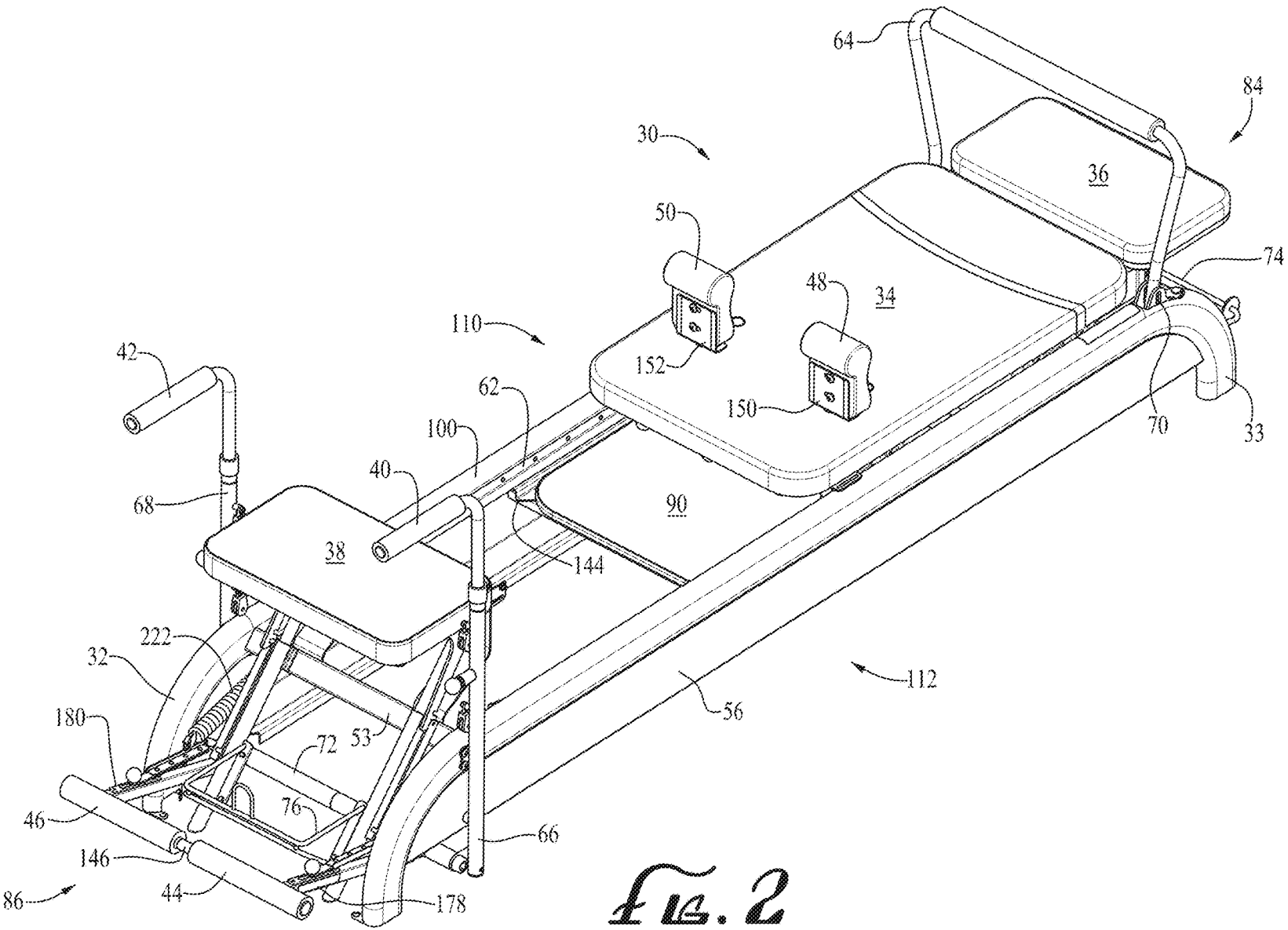
FIG. 2 is a top-back perspective view of the present exercise device, showing the seat in the raised configuration.

Referring to the illustrated assemblies of FIGS. 1-22, one example embodiment of an improved exercise machine or reformer (30) is presented. The present exercise machine (30) can be used in various methods of exercise, and preferably, with Pilates-style fitness regimens. Looking at FIG. 1, an embodiment of the present exercise machine (30) generally has a frame (32, 33) supporting a translating carriage (34), which rolls longitudinally atop rails (60, 62) between the front end (84) and back end (86) of the exercise machine (30). Near the front end (84) is a front platform (36) and a kick bar (64) which can be tilted about the frame (32, 33). Near the back end (86) is a vertically and diagonally adjustable seat (38) and foot pedals (44, 46). Also, near the back end (86) is a pair of handle bars (40, 42) (which can also be used as foot bars), supported respectively by vertical handle bar posts (66, 68).

FIG. 1 illustrates the seat (38) in the lowered configuration, where the seat (38) is substantially level with the translating carriage (34) and the front platform (36). Further, the translating carriage (34) is shown positioned towards the front end (84) of the machine (30), adjacent to the front platform (36). One portion of the user's body may be supported on the translating carriage (34), while another portion of the body may be supported by either the front platform (36), when closed, or the seat (38), while in the lowered configuration. For example, the user may place one foot on the translating carriage (34) and place the other foot on either the platform (36) or the seat (38). Or, alternatively, the user's torso may be supported by the translating carriage (34) while the feet are on either the platform (36) or the seat (38).

The translating carriage (34) has four wheel assemblies (200) on the underside (as will be described further in reference to FIGS. 18-20 and 27). The wheels engage rails (60, 62) with L-shaped cross sections that are attached to each inner side (98, 100) of the frame sides (32, 33). The rails (60, 62) provide support and linear guidance to permit the translating carriage (34) to roll in a straight line between the front end (84) and the back end (86). Normally, the translating platform (30) is permitted to freely roll along the rails (60, 62), but may be selectively connected by one or more resistance springs (102) to an anchor plate (104) (shown in FIG. 4) on the frame (32, 33). The resistance springs (102) resistively connect the translating carriage (34) to the frame (32, 33), so that the translating carriage (34) is spring-biased towards the front end (84). The user must overcome the spring bias in order to move the translating carriage (34) towards the back end (86). The resistance level may be adjusted by connecting a chosen number of resistance springs (102) to the anchor plate (104), as will be discussed in reference to FIG. 14.

In one example exercise, the user may rest on her back, with her shoulders against the shoulder rests (48, 50) and her feet towards the front end (84), with one or more feet touching the kick bar (64). With at least one resistance spring (102) connecting the carriage (34) to the anchor plate (104), the user must push or kick with enough force to overcome the resistance, causing the connected springs (102) to stretch. Further, the carriage (34) may be moved by pulling on handled ropes attached to the carriage (34) through various pulleys, as will be discussed in greater detail below. In various exercises, the user may also remove the balance bar (54) from the balance bar brackets (55). The handle bars (40, 42) are generally L-shaped, and are telescopically inserted into vertical handle bar posts (66, 68), forming a sliding fit. The handle bars (40, 42) are each permitted to rotate about the vertical axis within their respective handle bar posts (66, 68), either through a limited rotation or a full 360° rotation. Additionally, the height of the handles may be adjusted by sliding one or both of the handle bars (40, 42) axially within the handle bar posts (66, 68). Spring-loaded pull pins (106, 108) may be used to hold one or both the vertical and rotational positions. The pull pins (106, 108) are welded to the external surface of the handle bar posts (66, 68), such that an internal pin may be inserted and removed from a corresponding series of holes created in the handle bars (40, 42). A user simply pulls on a pull pin (106 or 108) while lifting or lowering the handle bar associated with the pull pin. The user may release the pull pin (106 or 108) and move the handle bar (40 or 42) until the pin aligns with one of the holes in the handle bar (40 or 42), allowing the pin to insert into one of the holes under spring force.

Figure 34:
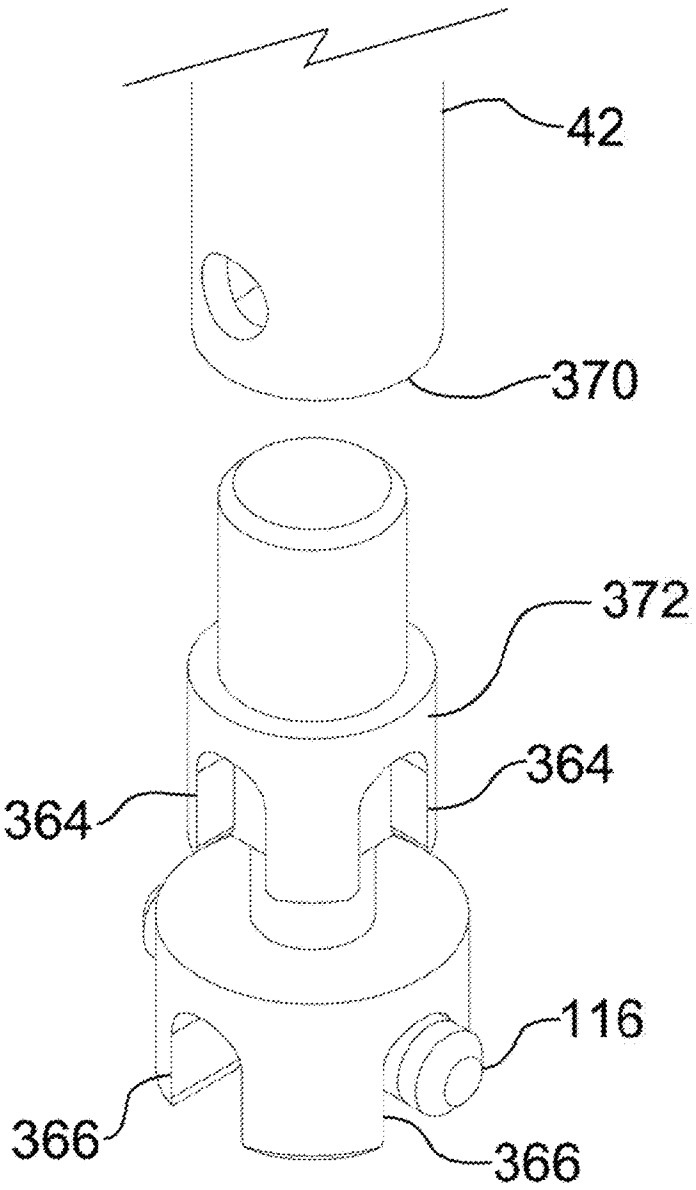
FIG. 34 is an exploded partial perspective view of the lower end of the handle bars, showing the locator assembly for controlling the rotational position of the handle bars.

The handle bars (40, 42) may also be incrementally rotated, so that the horizontal handle portions (with the foam rubber grips) may separately be rotated by 90° increments to point towards the front end (84), the back end (86), the left side (110), or the right side (112). As seen in FIG. 34, the bottom end of the vertical portion may be formed with two grooves (366) intersecting at 90° or any other desired angle, although any number of grooves may be formed. The grooves (366) may be formed on the end of a solid metal or plastic locator (368), much like the nock of an arrow, that is inserted into the bottom end (370) of the handle bars (40, 42). One corresponding locating pin (114, 116) is pressed radially through each of the bottom ends (118, 120) of the handle bar posts (66, 68). The pins (114, 116) are sized to lie within one of the intersecting grooves to hold the rotational position of the handle bars (40, 42). The user may lift the handle bars (40, 42) and rotate it by a 90° increment, then drop it onto the pin (114, 116) so that the pin locates within one of the two intersecting grooves (366).

The locator (368) further includes four stopped dados (364) formed on the outer wall (372) of the insert (368) and located in 90° increments about the circumference of the outer wall (372), or other desired increment. The diameter of the outer wall (372) preferably matches the diameter of the handle bar (42) tube. The stopped dados (364) receive the pin of pull pins (106, 108) when each of the handle bars (40, 42) are in a raised position. Thus, the intersecting grooves (366) hold the rotation of the handle bars (40, 42) when in the lowered position; and the stopped dados (364) hold the rotation of the handle bars (40, 42) when in the raised position. Because the outer wall (372) is the same diameter of the handle bar (42) tube, the user can lift either handle bar (40, 42) with the spring-loaded pull pins (106, 108) sliding against the outer diameter of the handle bars (40, 42), until encountering one of the stopped dados (364), where the respective pull pin (106, 108) will located with the stopped dado (364) under spring force. Because the stopped dados (364) are open at one end, the user can again lift the handle bars (40, 42) and rotate them into engagement with another stopped dado (364). To lower the handle bars (40, 42) into the lowered position, the user disengages the respective pull pin (106, 108) so that the closed end of the stopped dado (364) cannot engage the pull pin, thus allowing the respective handle bar (40, 42) to slide past the respective pull pins (106, 108).

There are other means known in the art for holding both rotational and vertical positions of the handle bars (40, 42), such as a frictional lock, where the user loosens or tightens a nut at the mouths of the handle bar posts (66, 68) to change and hold the positions of the handle bars (40, 42). With any of the above means, the user may change the position (height or rotation) of the handle bars (40, 42) to correspond to a given exercise or different comfort level.

The kick bar (64) is generally U-shaped, with a straight horizontal section and two vertical sections which each connect to the frame (32, 33) through tilt adjustment mechanisms (70, 71). The straight horizontal section is preferably encased in a grip material, such as foam rubber or other cushioning and gripping material. The angle or tilt of the kick bar (64) may be adjusted relative to vertical. For example, in a first position, the kick bar (64) may extend vertically, as shown in FIG. 1. Additionally, the kick bar (64) may be angled towards the front end (84) or towards the back end (86). In either of the above positions, the kick bar (64) is held firmly at a selected tilt angle by the tilt adjustment mechanisms (70, 71), such that the user may perform various exercises by contacting the kick bar (64). When desired, the kick bar (64) may be tilted to a horizontal stowed positon, extending towards the front end (84), such that the user may perform exercises not requiring the kick bar (64), as will be described further in reference to FIG. 12.

Figure 22:
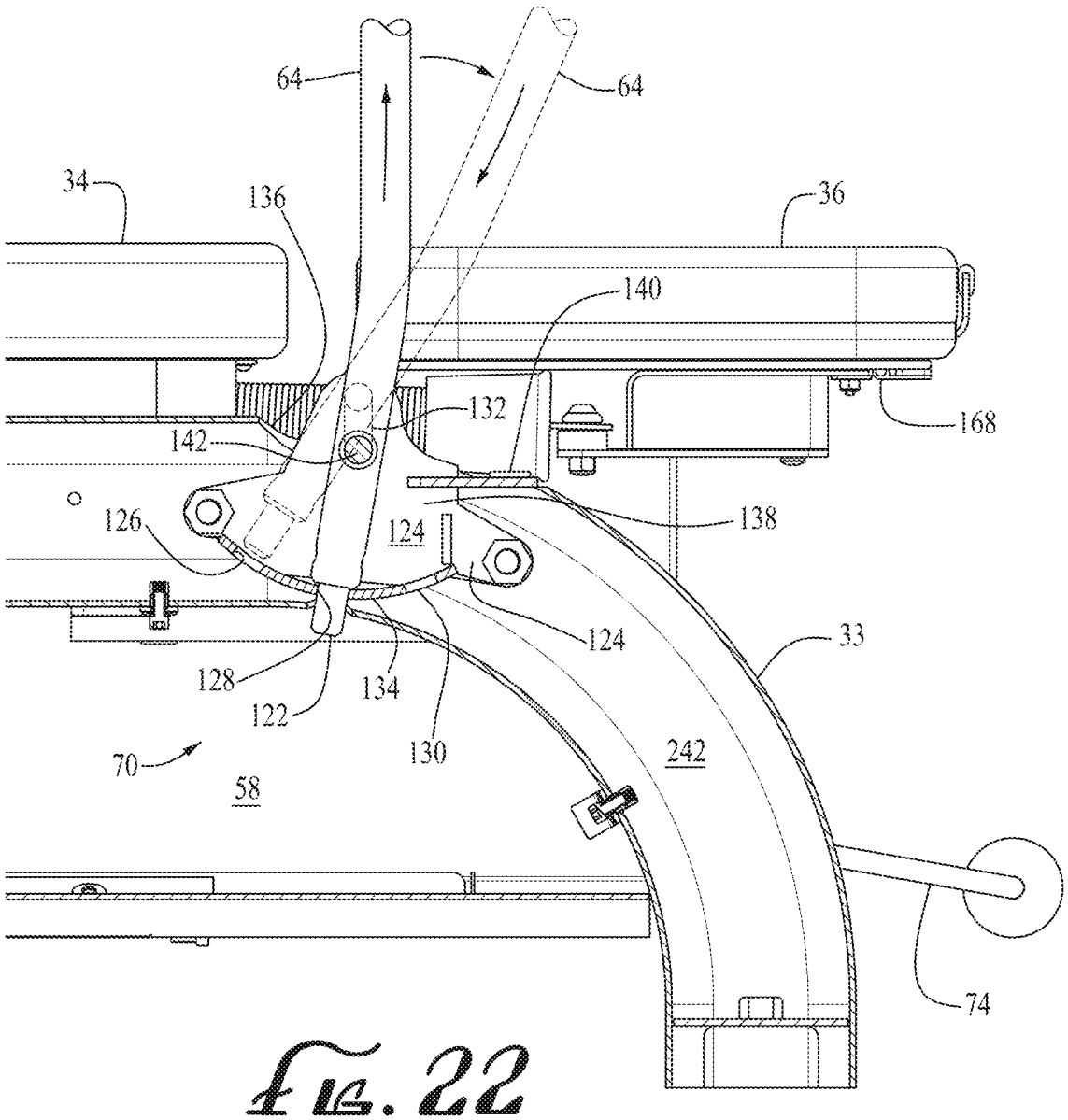
FIG. 22 is a magnified sectional view of the handle tilt adjustment system.

Now, referencing FIG. 22, one tilt adjustment mechanism (70) is shown in cross-section to illustrate the internal operation. Since both tilt mechanisms (70, 71) are preferably similar in design, just one side is illustrated, although the design may vary as required. A bracket (124) is bolted or otherwise attached to the inner wall (242) of the tubular frame (33), also shown in cross-section, with the kick bar (64) extending through an opening (136) in the frame (33). The bracket (124) has two planar parallel walls (138) (just the far wall is shown in FIG. 22), which preferably are similar in design or may differ if required. A curved plate (134) spans and joins the parallel walls (138). The curved plate (134) has a series of locating holes (126, 128, 130) which are configured to receive the end pin (122) protruding from each terminus of the kick bar (64). An elongated hole or slot (132) is formed oppositely on each wall (138) to receive a cross pin (142) radially intersecting the kick bar (64) near each terminus.

To change the tilt of the kick bar (64), the user lifts the kick bar (64) to remove the end pin (122) from its respective locating hole (126, 128, or 130), tilts the kick bar (64), then lowers the kick bar (64) is one the other locating holes. The slot (132) provides clearance about the cross pin (142) to permit the user to lift and lower the kick bar (64), while still providing support for rotation. Thus, the slot (132) is sufficiently long to permit the removal of the end pin (122) from one of the locating holes (126, 128, 130). In the illustrated example, the end pin (122) is initially inserted into locating hole (128). The user lifts the kick bar (64) to remove the end pin (122) from the locating hole (128), tilts the kick bar (64) clockwise, and lowers the end pin (122) into locating hole (126), as illustrated by the illustrated arrows.

If the user desires to stow the kick bar (64), she may lift the kick bar (122) to remove the end pin (122) from the locating hole (126, 128, 130), rotate the kick bar (64) clockwise until the kick bar (64) rests on support plate (140), so that the end pin (122) is not inserted into any of the locating holes (126, 128, 130) and is pointing towards the back end (86). A piece of felt, rubber, or other cushioning material may be attached to the top surface of the support plate (140) to reduce noise and metal-to-metal contact between the support plate (140) and the kick bar (64).

The carriage top side (96), the seat (38), and the front platform (36) preferably have a layer of cushioning covered by a vinyl or other appropriate fabric. A strap (not shown) extends from the left side (110) of the carriage (34) to the right side (112) of the carriage (34). The strap may be used to hold the user's feet while exercising or for other purposes. The jump board (90) (shown stowed under the carriage in FIG. 1) may also have cushioning material covered by fabric. The shoulder rests (48, 58) each have a metal bracket (150, 152) which supports the board or other internal framework of the shoulder rests (48, 58). The shoulder rests (48, 58) are similarly overlaid with a thick cushioning and covered with vinyl or fabric. The material choice for each surface may be similar or may differ depending on the use, the desired cushioning effect, and the desired fabric choice.

Figure 3:
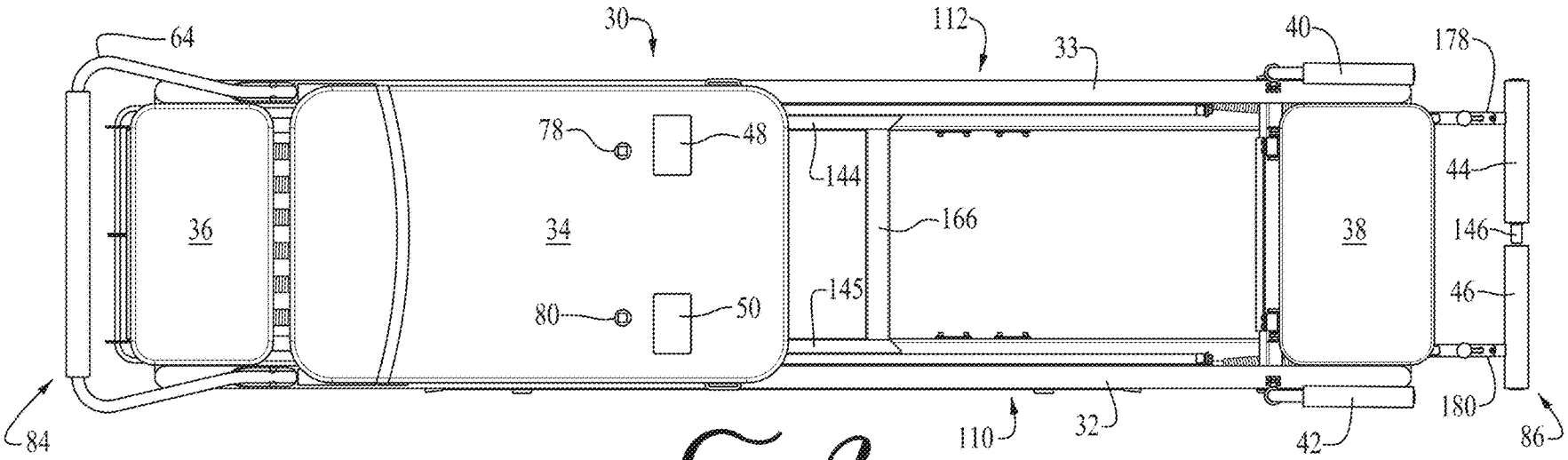
FIG. 3 is a top view of the of the present exercise device, showing the translating platform positioned towards the front of the device.
Figure 4:
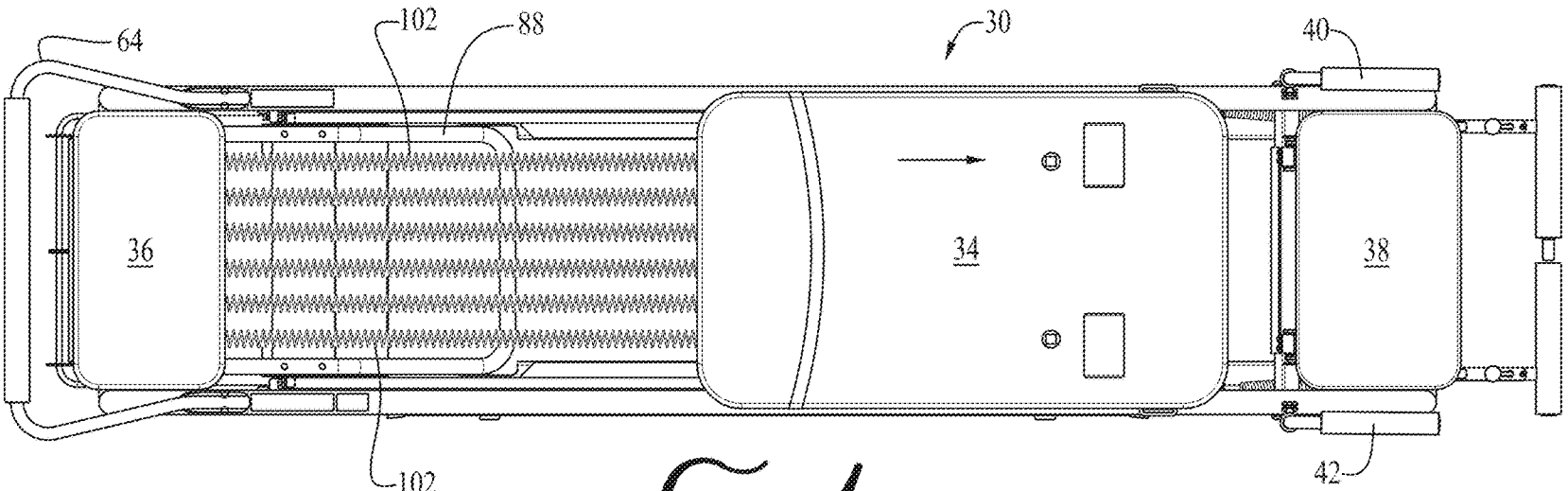
FIG. 4 is a top view of the of the present exercise device, showing the translating platform positioned towards the back of the device with the resistance springs stretched.

Viewing FIGS. 3-4, the exercise machine (30) is shown from above. In FIG. 3, the carriage (34) is positioned closest to the front end (84). While, in FIG. 4, the carriage (34) is positioned closest to the back end (86). A series of parallel resistance springs (102) are shown in an unstretched condition in FIG. 3, when the carriage is closest to the front end (84). The parallel resistance springs (102) are shown in a stretched condition in FIG. 4, when the carriage is closest to the back end (86). The resistance springs (102) are attached to the carriage underside (154), by eye bolts (198), and may each be selectively attached to an anchor plate (104) fastened to the frame (32, 33). FIG. 4 shows all of the resistance springs (102) connected to the anchor plate (also shown in FIG. 14). If no resistance is desired, then none of the springs (102) need be attached to the anchor plate (104). Although six resistance springs (102) are shown, fewer than six may be attached to the anchor plate (102); for example, one, two, or any number of springs may be attached. A fixed end (160) of each of the resistance springs (102) is attached to the carriage (34) by eye bolts (158), while a free end (162) of each of the resistance springs (102) may be selectively detached or attached to the anchor plate (104).

All or some of the resistance springs (102) may have similar spring constants. Alternatively, the spring constant may be varied from spring to spring. The spring constant and resulting spring force could be indicated by color-coding, labeling, or otherwise indicating the resistance level on each spring. Although springs are illustrated, other extendable resistance means may be used, such as elastic shock cords and the like.

Figure 5:
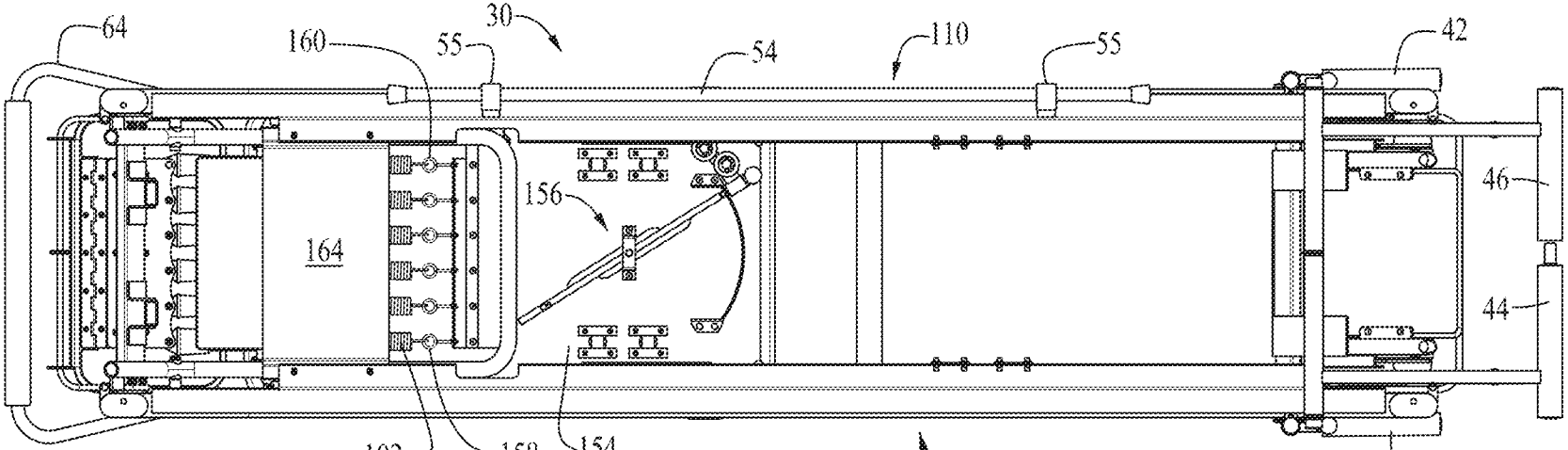
FIG. 5 is a bottom view of the of the present exercise device, showing the translating platform positioned towards the front of the device.

In FIG. 5, the present exercise device (30) is viewed from beneath. The rope equalizing mechanism (156) is located on the carriage underside (154). It is a common issue for the ropes to stretch unevenly, such that the free ends of the ropes become uneven with respect to one another, due to one rope being longer than the other. As a result, the handles attached to the free ends will also be uneven, ultimately causing uneven strain and discomfort to the exerciser. As will be described in greater detail below, the rope equalizing mechanism (156) enables the user to adjust the length of the ropes, so that the handles are even with one another. Further, the rope equalizing mechanism (156) equally shortens or lengthens the overall length of all the ropes simultaneously to suit the user. A bottom plate (164) spans between frame members (32 and 33).

Figure 6:
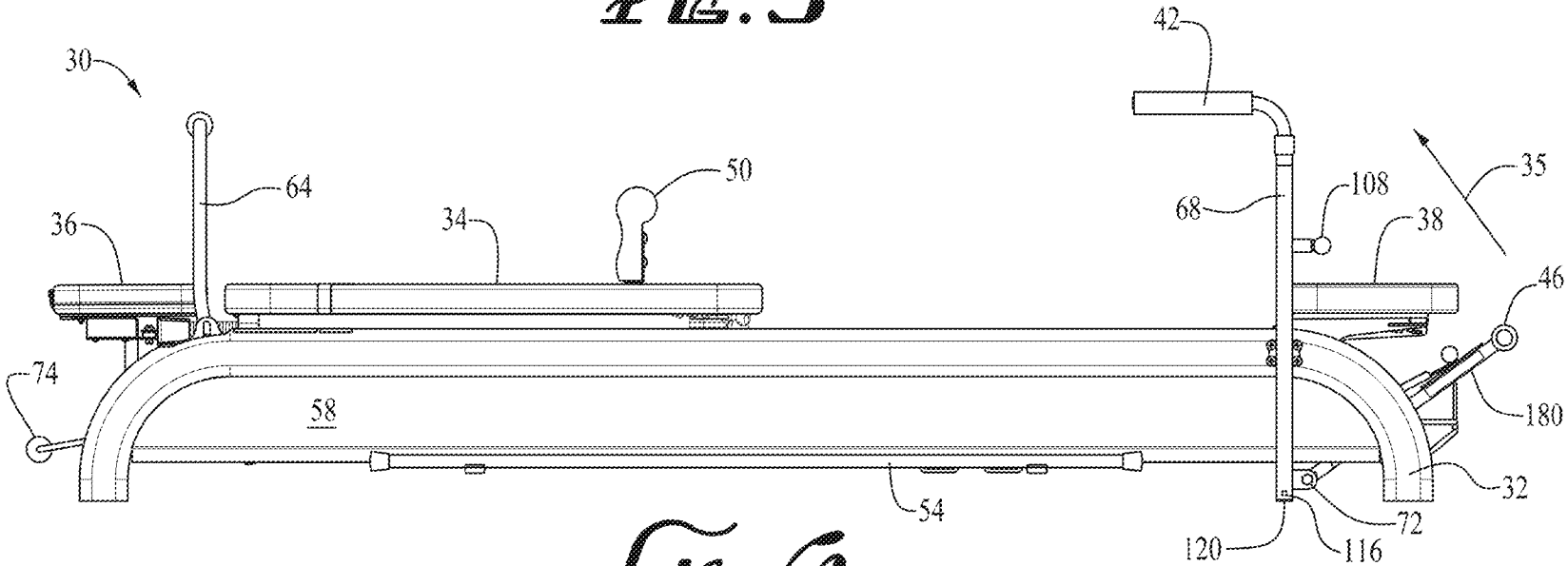
FIG. 6 is a left side view of the of the present exercise device, showing the translating platform positioned towards the front of the device.
Figure 7:
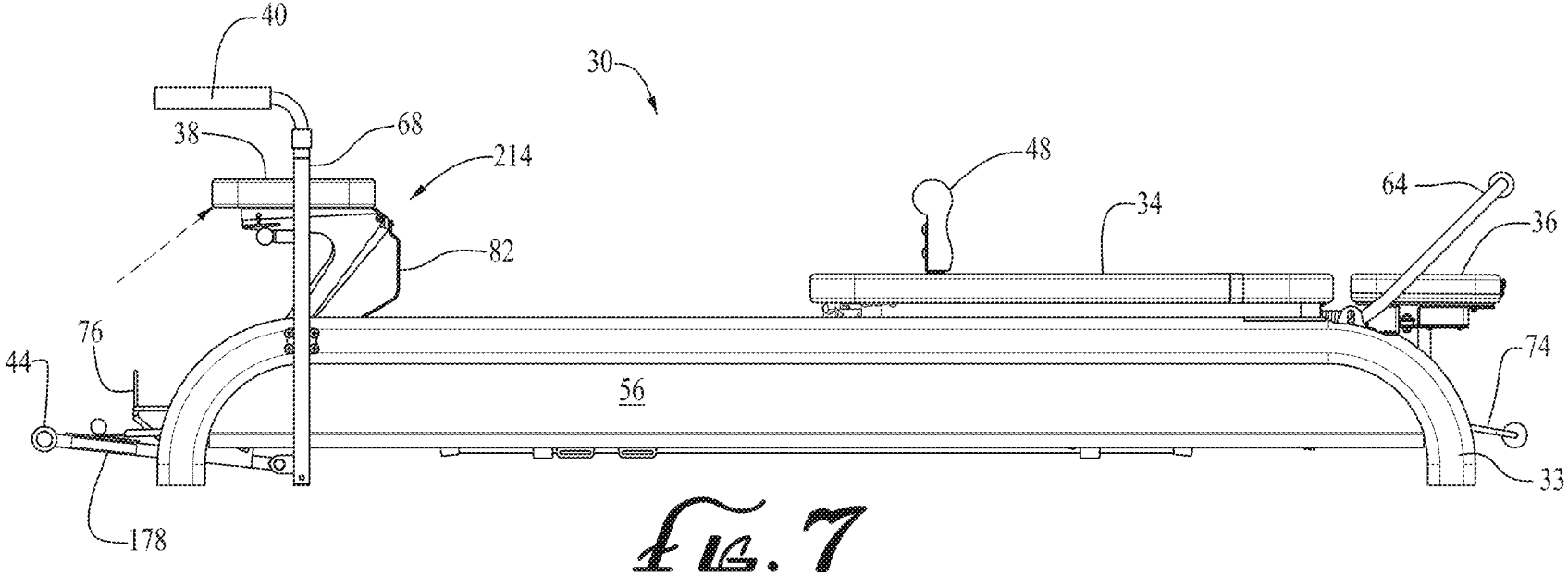
FIG. 7 is a right side view of the of the present exercise device, showing the translating platform positioned towards the front of the device and the seat in the raised configuration.

FIGS. 6 and 7 are left and right side views of the present exercise device (30), where FIG. 6 shows the seat (38) in a lowered configuration, and FIG. 7 shows the seat in a raised configuration. The operation of the seat adjustment assembly (214) will be described in greater detail in reference to FIGS. 15, 16, 25, and 30A-D. When comparing the seat (38) position shown in FIG. 6 with the seat position shown in FIG. 7, the seat (38) is not only elevated in FIG. 7, it is translated towards the front end (84), in a diagonal movement. The benefit of a diagonal movement is that the user is provided clearance to operate the pedals (44, 46), and to permit the pedals (44, 46) to extend just a small length beyond the frame (32, 33). Because the seat (38) can move up and back in a smooth diagonal movement, the user can easily gain access to the pedals (44, 46) for a lower body workout.

Figure 9:
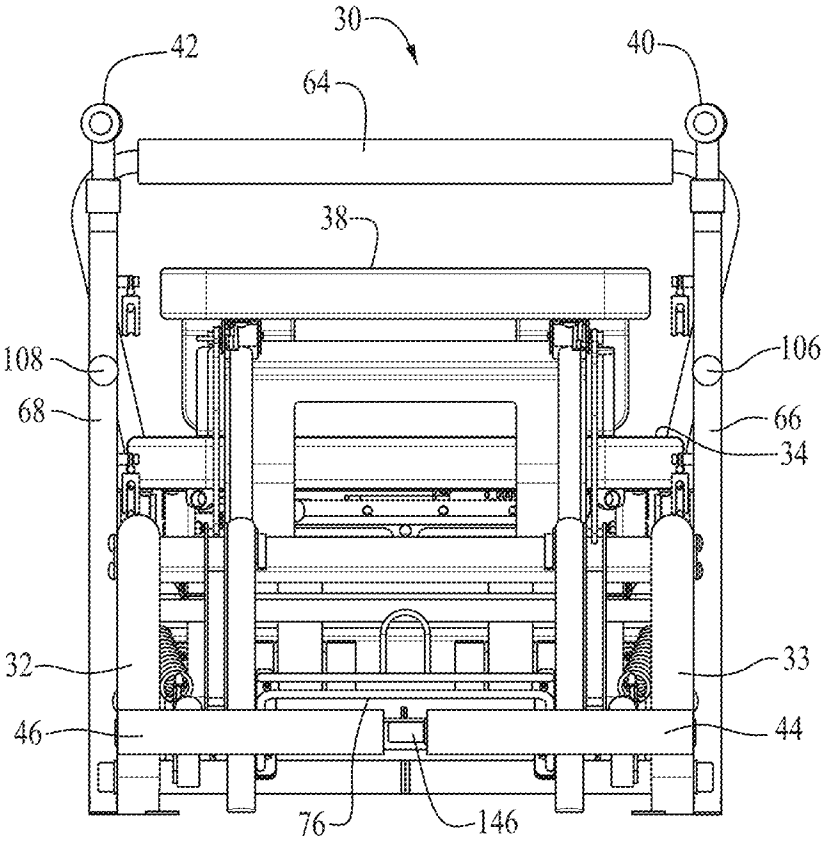
FIG. 9 is a back view of the present exercise device, showing the seat in the raised configuration.
Figure 8:
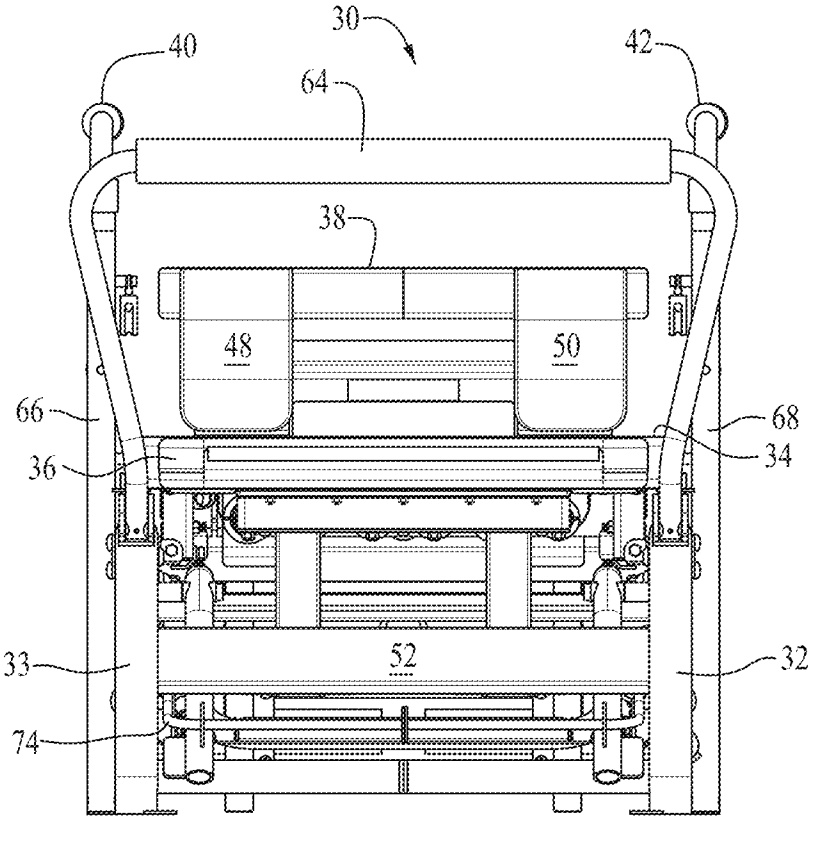
FIG. 8 is a front view of the present exercise device, showing the seat in the raised configuration.
Figure 28:
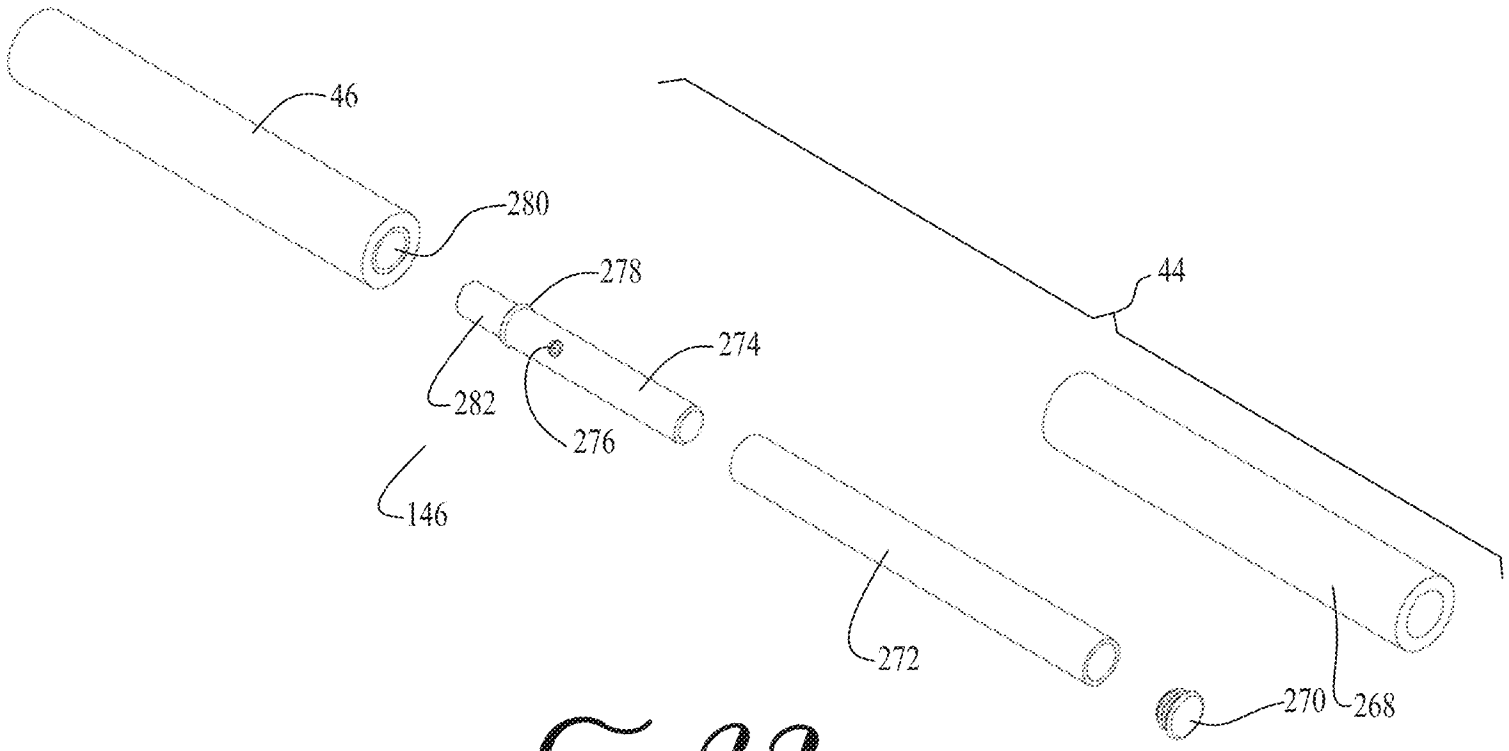
FIG. 28 is a perspective view of the pedal locking mechanism, shown in isolation from the remainder of the exercise device.

FIGS. 8 and 9 show the front end (84) and the back end (86), respectively. FIGS. 9 and 28, in particular, shows the pedal locking mechanism (146), which serves to lock pedal (44) to pedal (46), such that the pedals (44 and 46) move together even when just one of the pedals is pushed. When unlocked, the pedals (44, 46) move independently from one another, where one can be pushed down while the other remains up. In FIG. 28, pedal (44) is shown exploded to illustrate the internal working of the locking mechanism (146). Locking pin (274) has a detent (276) on the outer diameter and an O-ring (278) about its circumference. The locking pin (274) axially slides within the pedal frame tube (272). To lock the pedals (44 and 46) together, the pedals (44, 46) are aligned, and the end portion (282) of the locking pin (274) is inserted into the locking pin hole (280) in pedal (46). The detent (276) prevents unintended withdrawal of the end portion (282) from the hole (280) by contacting the edge of pedal frame tube (272); while the O-ring (278) blocks further insertion of the end portion (282) into the hole (280). To unlock the pedals (44, 46), the user grasps the locking pin (274), depresses the detent (276), and pushes it axially back into the pedal frame tube (272). The detent (276) may alternatively be designed to retract upon contacting the pedal frame tube (272), if sufficient force is applied. End cap (270) covers the end of the pedal frame tube (272); and the foam rubber grip (268) covers the pedal frame tube (272).

Figure 10:
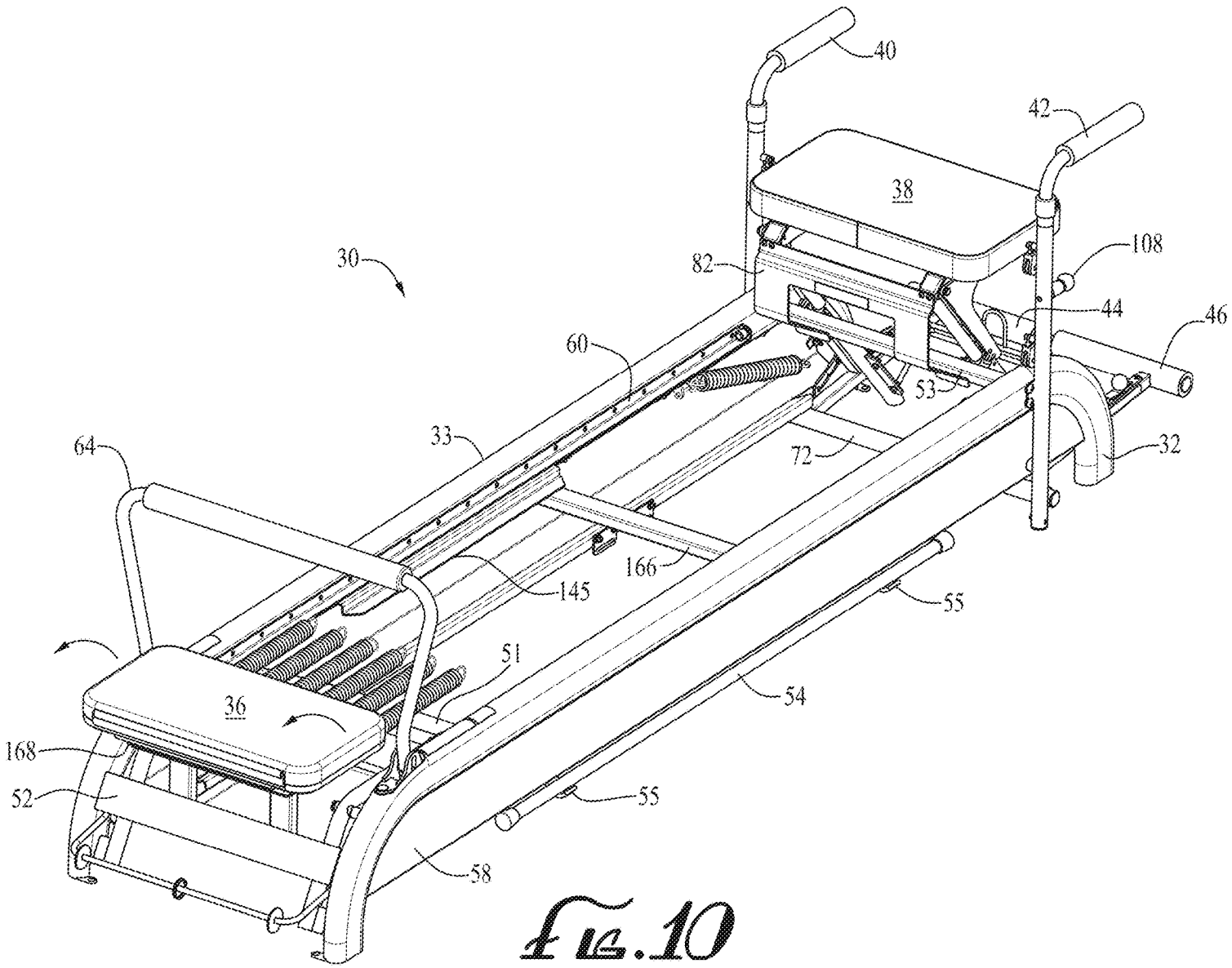
FIG. 10 is a top-front perspective view of the present exercise device, showing the seat in the raised configuration and with the translating platform removed.

FIG. 10 illustrates the present exercise device (30) with the carriage (34) and jump board (90) removed, so that the general frame structure can be more easily viewed. The structure is primarily made of two parallel tubular frame members (32, 33) connected by several cross members (51, 52, 53) and a central cross member (166). Jump board brackets (144, 145) are connected to the frame inner sides (98, 100), beneath the rails (60, 62). The tubular frame members (32, 33) generally curve downwards at each end to form legs for supporting the remainder of the exercise machine (30) above the floor. The seat (38) is shown in the raised configuration, with the carriage stop (82) in position to limit the travel of the carriage (34) when the seat (38) is raised.

Figure 11:
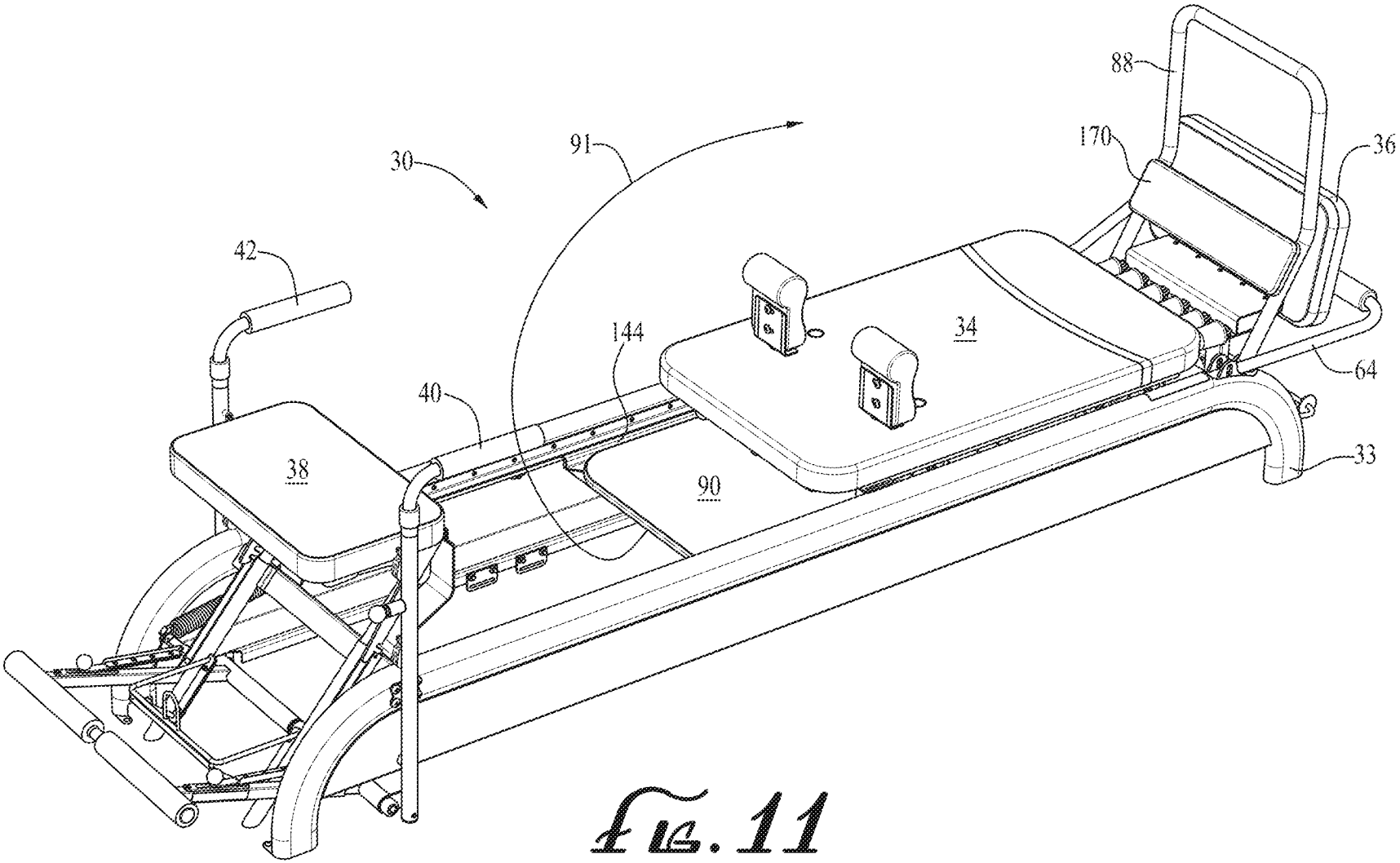
FIG. 11 is a top-back perspective view of the present exercise device, showing the seat in the raised configuration, the front platform opened, and the jump board frame deployed.

As indicated by the curved arrows in FIG. 10 adjacent to the front platform (36), front platform (36) is connected to the frame by a hinge (168) to permit the front platform (36) to rotate towards the front end (84). Further, as shown in FIG. 11, the kick bar (64) is rotated towards the front end to a horizontal position. Then, the front platform (36) is rotated from a horizontal orientation to a vertical orientation, about the hinge (168). The resistance springs (102) are disconnected from the anchor plate (104); and the carriage is moved towards the back end (86). Then, the jump board frame (88) can be rotated from its stowed position, normally under the travel plane of the carriage (34), to a vertical deployed position (as shown in FIG. 11). The jump board frame (88) is a tube bent into a U-shape, with a lower jump board (170) spanning the two vertical portions. When the carriage (34) is moved towards the front end (84), the detachable jump board (90) is removed from beneath the carriage (34) and carried manually to the jump board frame (88), as indicated by arrow (91).

Figure 12:
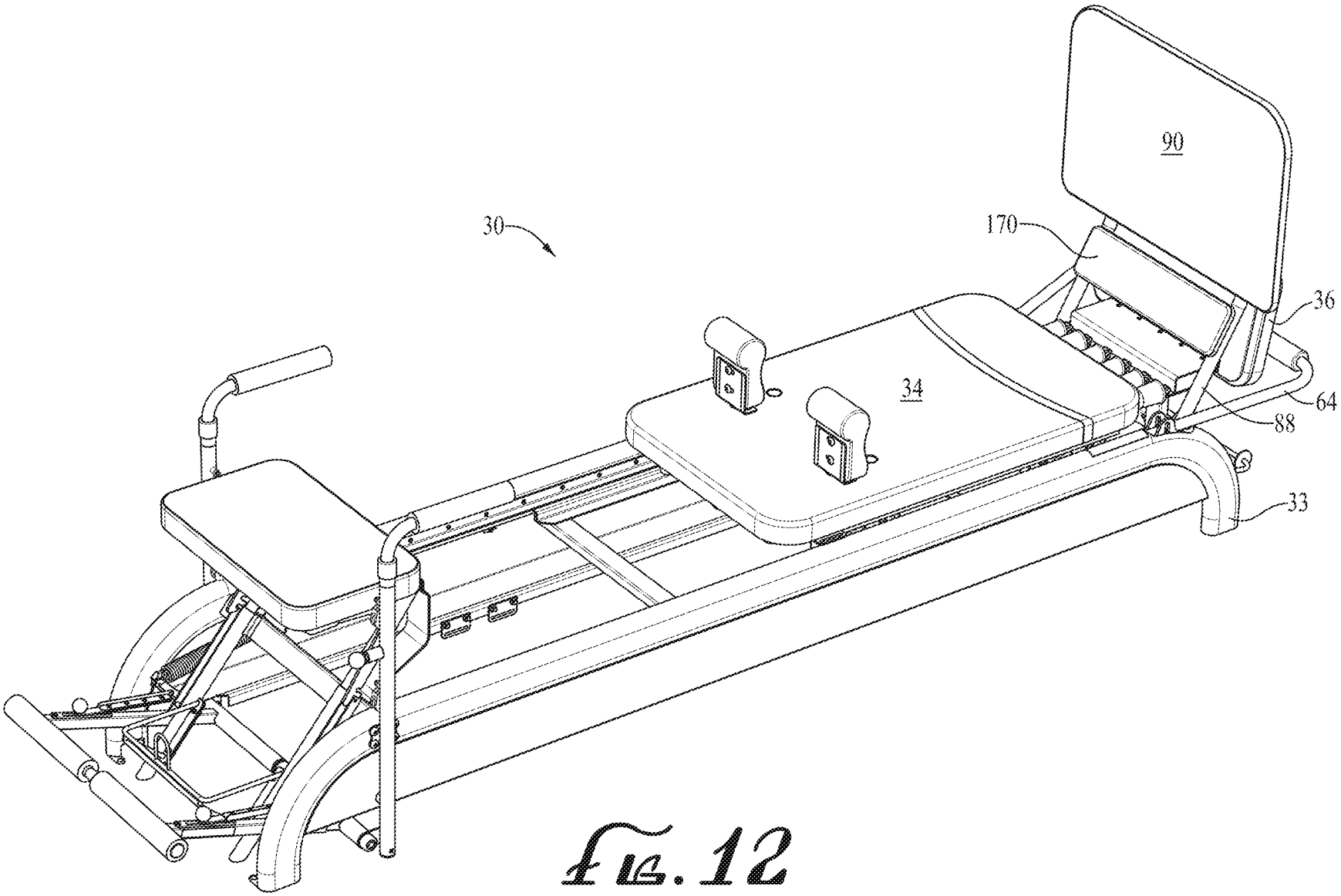
FIG. 12 is a top-back perspective view of the present exercise device, showing the seat in the raised configuration, the front platform opened, and the jump board frame deployed with the jump board attached.
Figure 13:
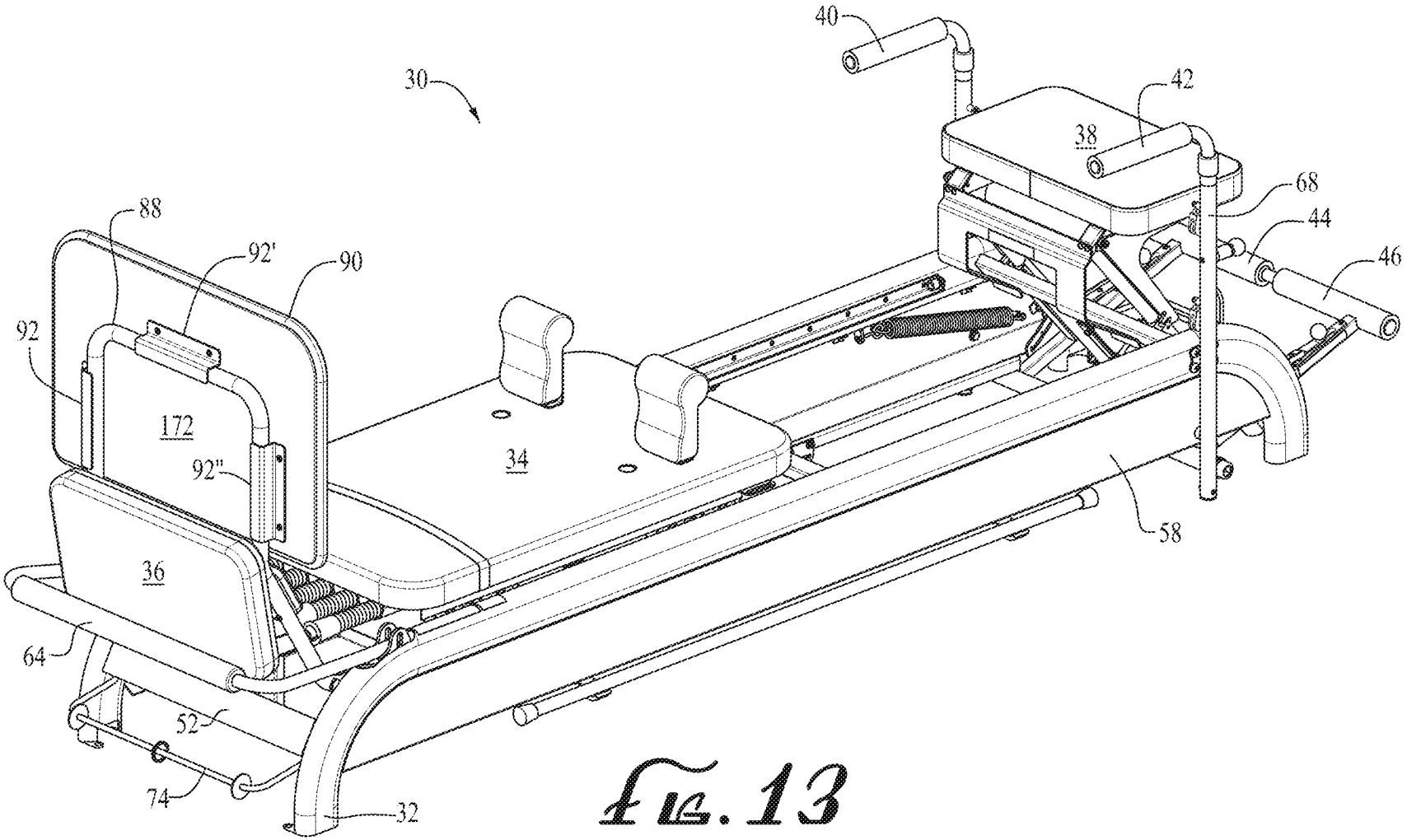
FIG. 13 is a top-front perspective view of the present exercise device, showing the seat in the raised configuration, the front platform opened, and the jump board frame deployed with the jump board attached.

As shown in FIGS. 12-13, the jump board (90) has three brackets (92, 92', 92") on the back surface. The three brackets (92, 92', 92") engage the sides and top of the jump board frame (88) to hold the jump board (90) in a vertical position on the jump board frame (88). When the jump board (90) is hung in the vertical position, the user may lay on her back on the carriage (34), with her shoulders on the shoulder rests (48, 50), and kick off the jump board (90) using her feet.

Figure 14:
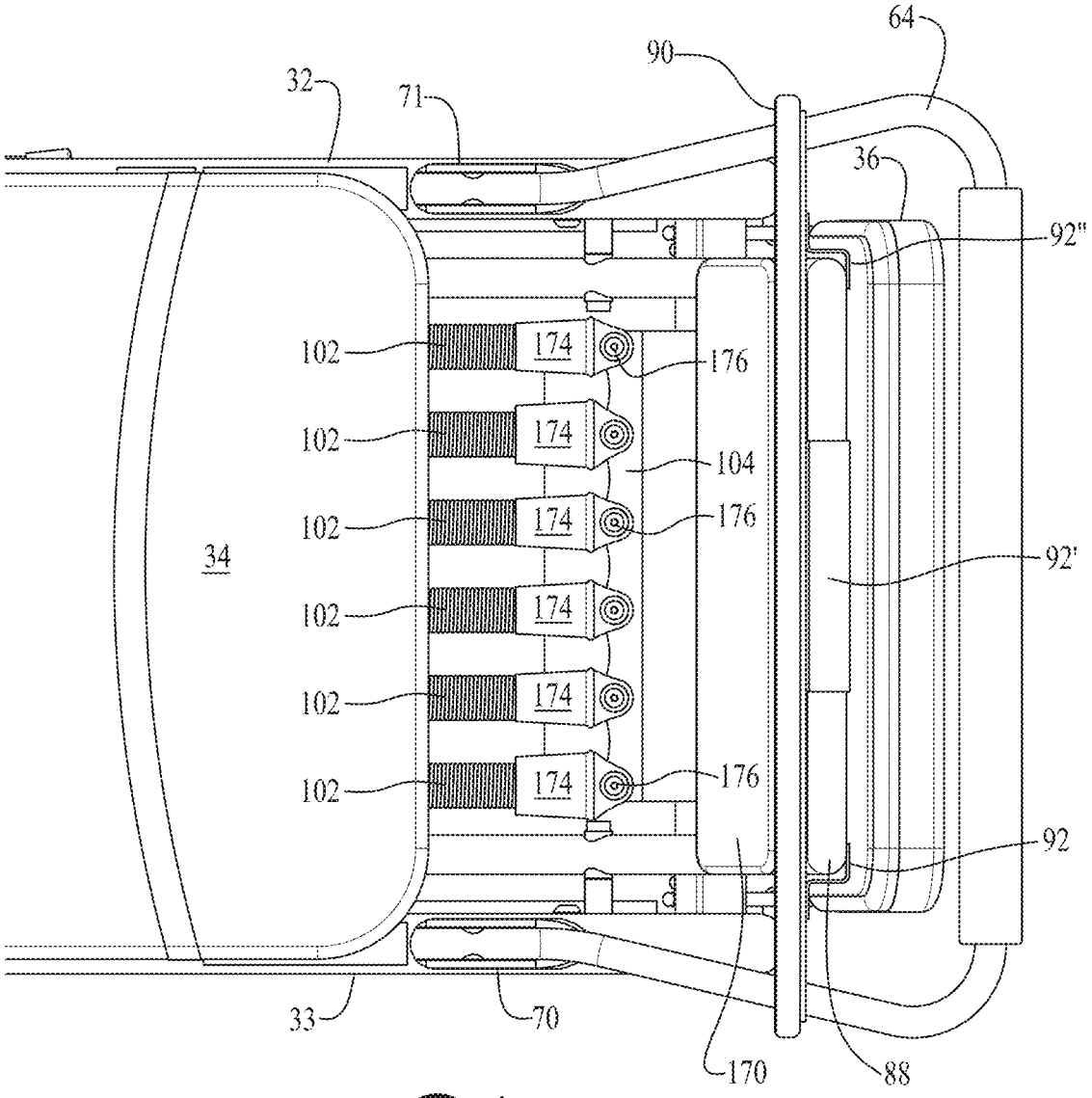
FIG. 14 is a partial top view of the present exercise device, showing the resistance spring attachment system.
Figure 14:
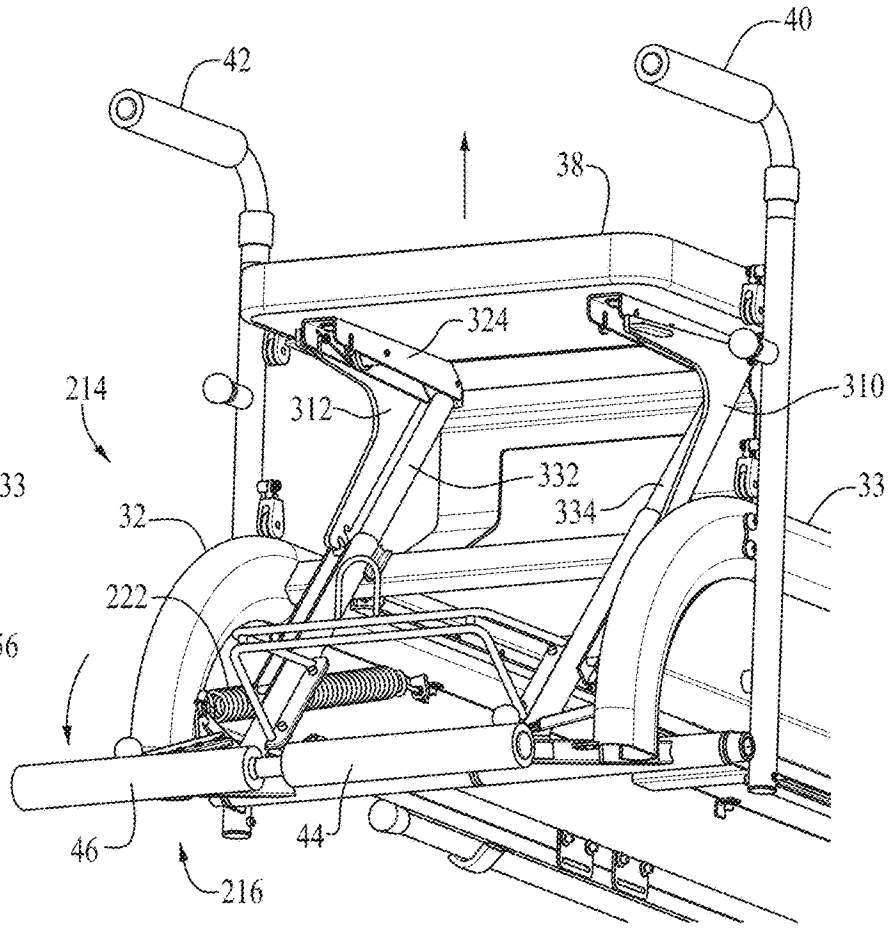
Figure 31A:
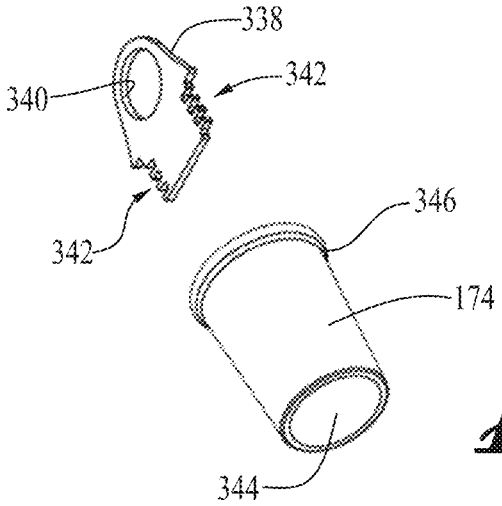
FIG. 31A is an exploded perspective view of the spring connector assembly and carriage resistance spring.
Figure 31B:
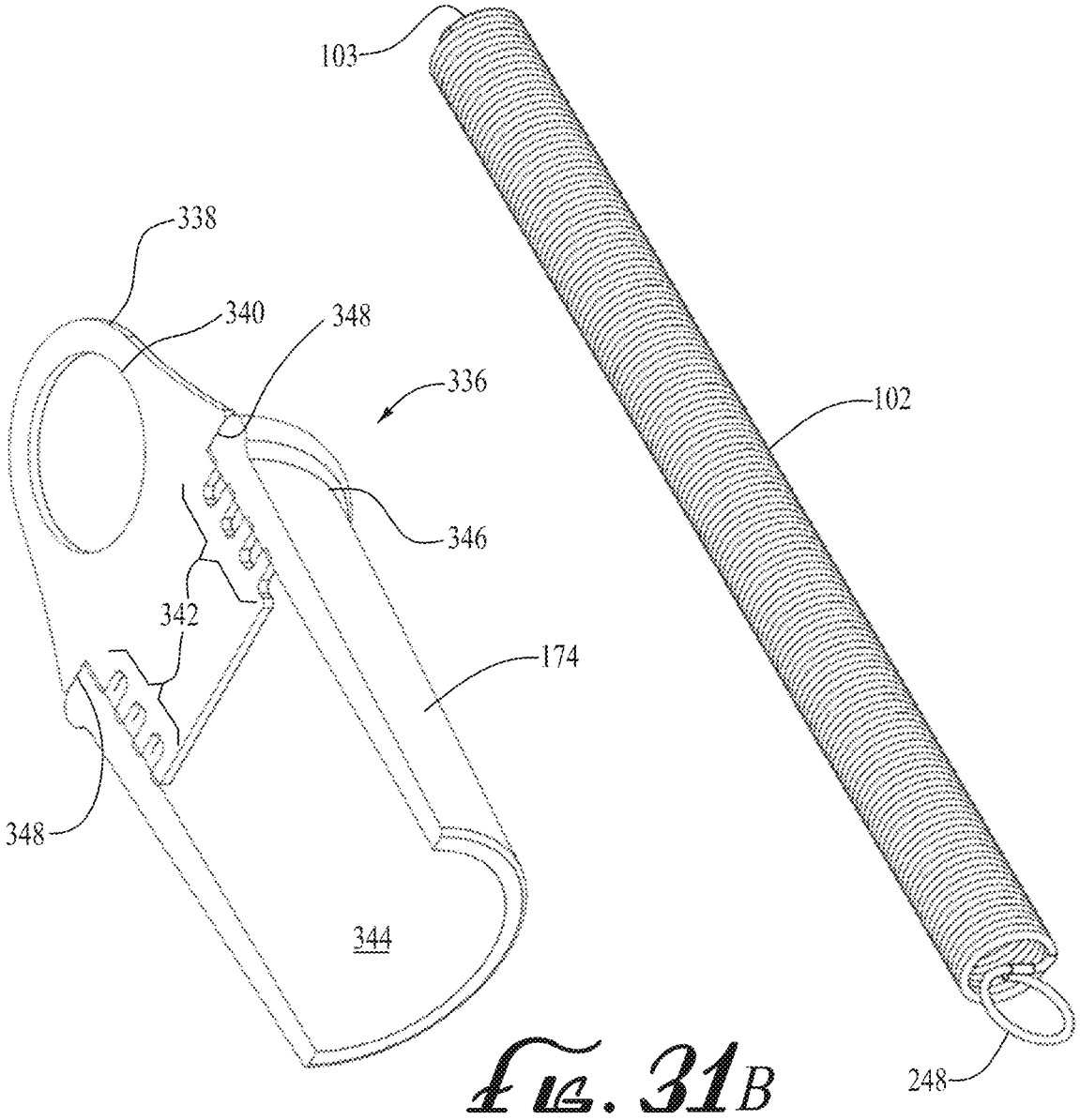
FIG. 31B is a cross-sectional perspective view of the spring connector assembly.

As shown in FIGS. 14 and 31A-B, at the free end (103) of each spring (102) is a spring connector (174), which connects to the free end of the coil spring (102). Looking at FIGS. 31A-B, the spring connector (174) has a hollow interior portion (344) for receiving the free end (103) of the spring (102), and an eyelet (340) is designed to receive a corresponding peg (176) extending from the anchor plate (170). The peg (176) may be a metal pin or screw covered with a plastic sleeve, having an annular groove to engage the eyelet (340). The spring connector is slightly tapered and has an annular shoulder (346). The free end (103) of the spring (102) is inserted through the hollow portion (344). The coils of the free end (103) are threaded about the connector plate (338), such that the coils lie within the spring notches (342) of the connector plate (338) to lock the spring (102) to the connector plate (338). The spring (102) free end (103), with the connector plate attached, is then pulled into the hollow portion (344) until the shoulders (348) of the connector plate (338) contact the spring connector (174). Thus, the spring (102) may be stretched by pulling on the spring connector (174), without the spring (102) withdrawing.

The user grasps the spring connector (174) and slightly stretches the spring (102) by pulling on the spring connector (174) so that the eyelet can be engaged or disengaged to the corresponding peg (176). The illustration of FIG. 14 shows all springs (102) connected to their corresponding pegs (176), at maximum resistance. As will be discussed in greater detail in reference to FIGS. 31A-B, the connector is ergonomically designed with a tapered portion and a shoulder to facilitate grasping by hand.

Figure 15:
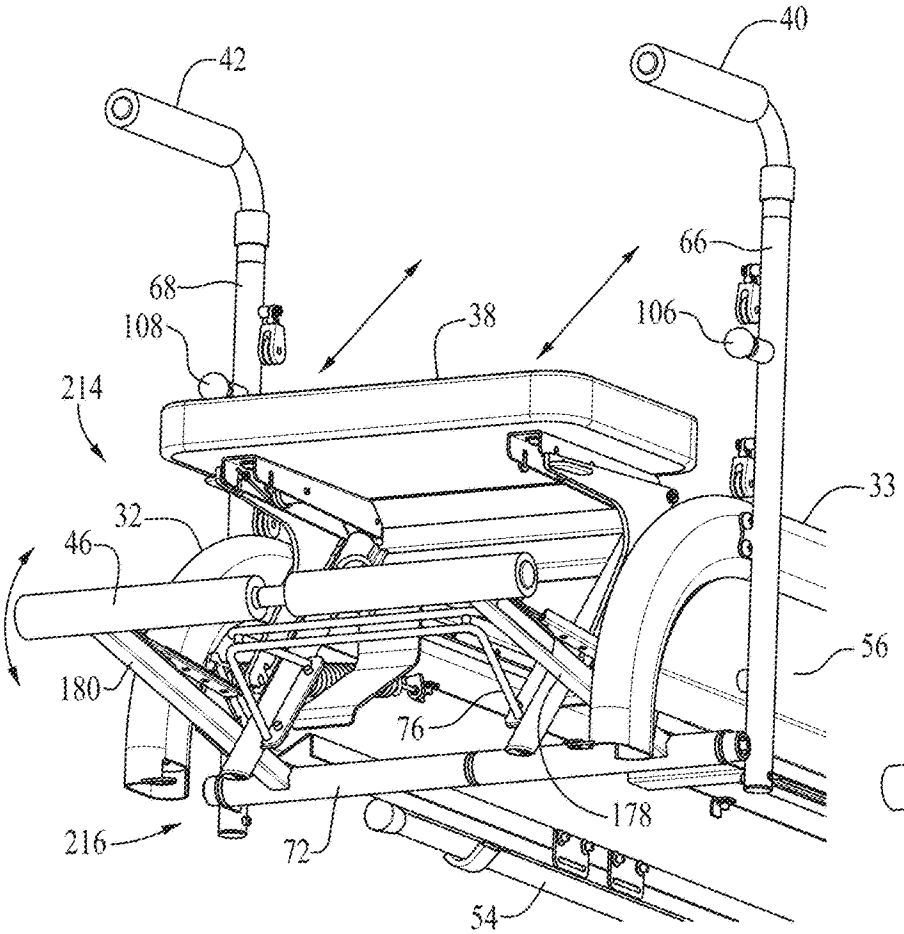
FIG. 15 is a partial bottom-back perspective, showing the seat and pedal mechanism, with the seat in the lowered configuration.

FIGS. 15 and 16 illustrate the seat adjustment system (214) transitioning from the lowered position (in FIG. 15) to the raised position (in FIG. 16). Further, the pedal assembly (216) is shown transitioning from the highest position (in FIG. 15) to the lowest position (in FIG. 16). As will be discussed in references to FIGS. 25 and 30A-D, the seat (38) may be selectively locked in the lowered position or the raised position, and released by manual depression of a latch mechanism (218). As will be discussed in references to FIG. 23, the resistance provided by the pedal springs (220, 222) the pedal assembly (216) may be varied by adjustment of the connection points of the pedal springs to the pedal arms (178, 180).

Figure 17:
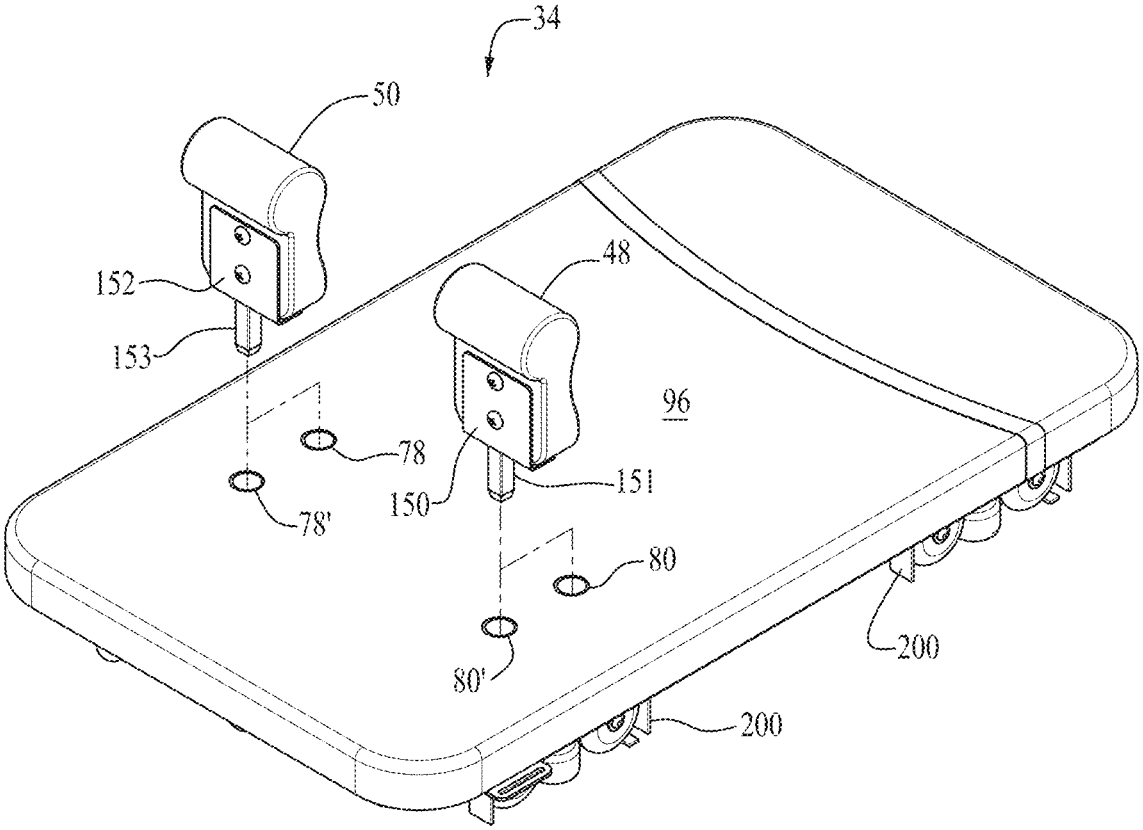
FIG. 17 is a top perspective view of the translating platform with the shoulder rests shown exploded from the translating platform.

Looking now at FIG. 17, the translating carriage (34) is shown in isolation from the exercise device (30), with the shoulder rests (48, 50) shown exploded from the carriage (34). Each shoulder rest (48, 50) is comprised of a metal bracket (150, 152) to which the cushioned portion of the shoulder rest (48, 50) and internal support board is attached. The bracket (150, 152) is preferably made of steel or other high-strength material. Square rods (151, 153) extend downwardly from the rigid bracket (150, 152) to selectively insert within either shoulder rest socket (78 and 80) or shoulder rest sockets (78' and 80'), depending on the exercise and the user preferences. Four wheel assemblies (200) are attached to the carriage underside (94), which permit linear rolling of the carriage (34) on the rails (60, 62).

Figure 18:
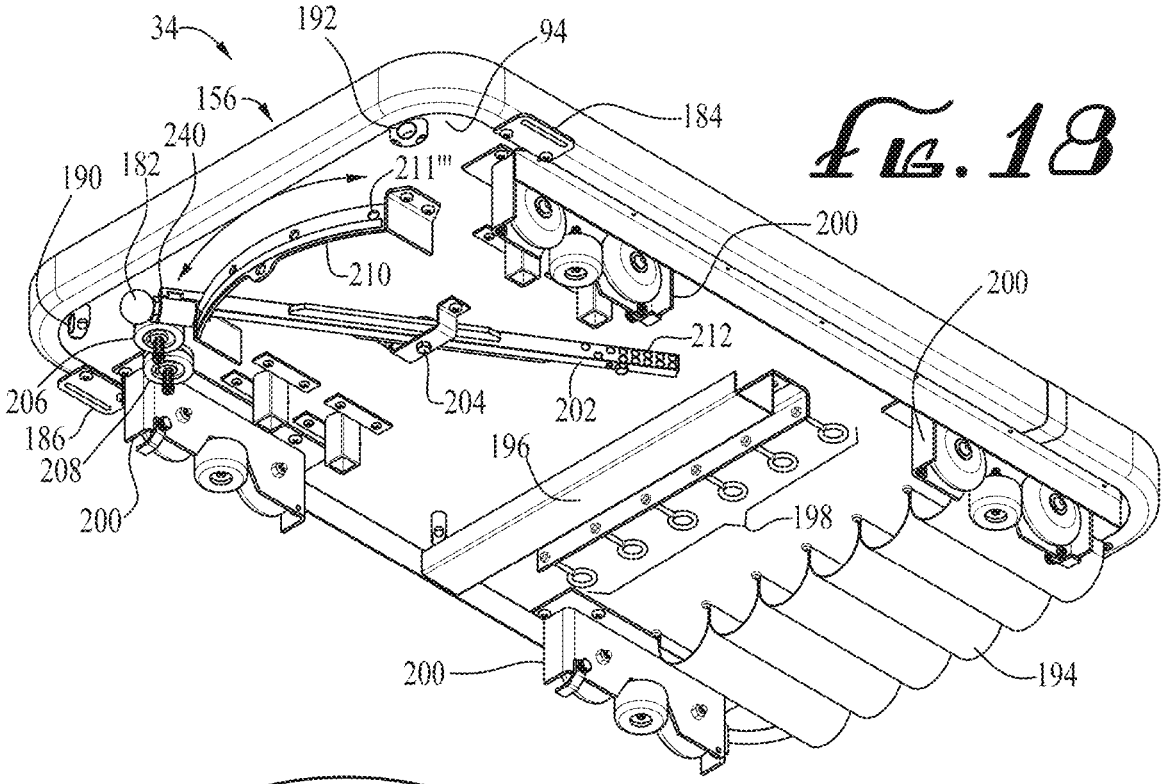
FIG. 18 is a bottom perspective view of the translating platform in a first adjustment configuration.
Figure 19:
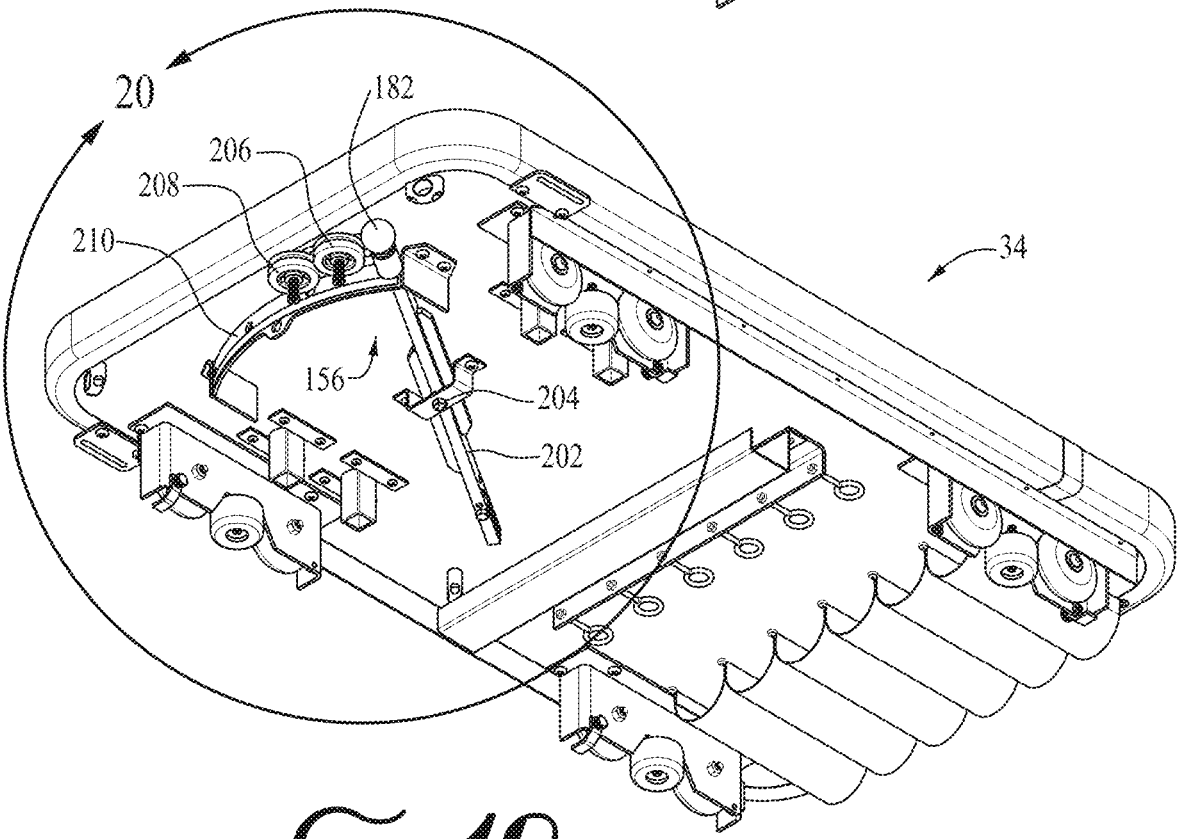
FIG. 19 is a bottom perspective view of the translating platform in a second adjustment configuration.
Figure 24:
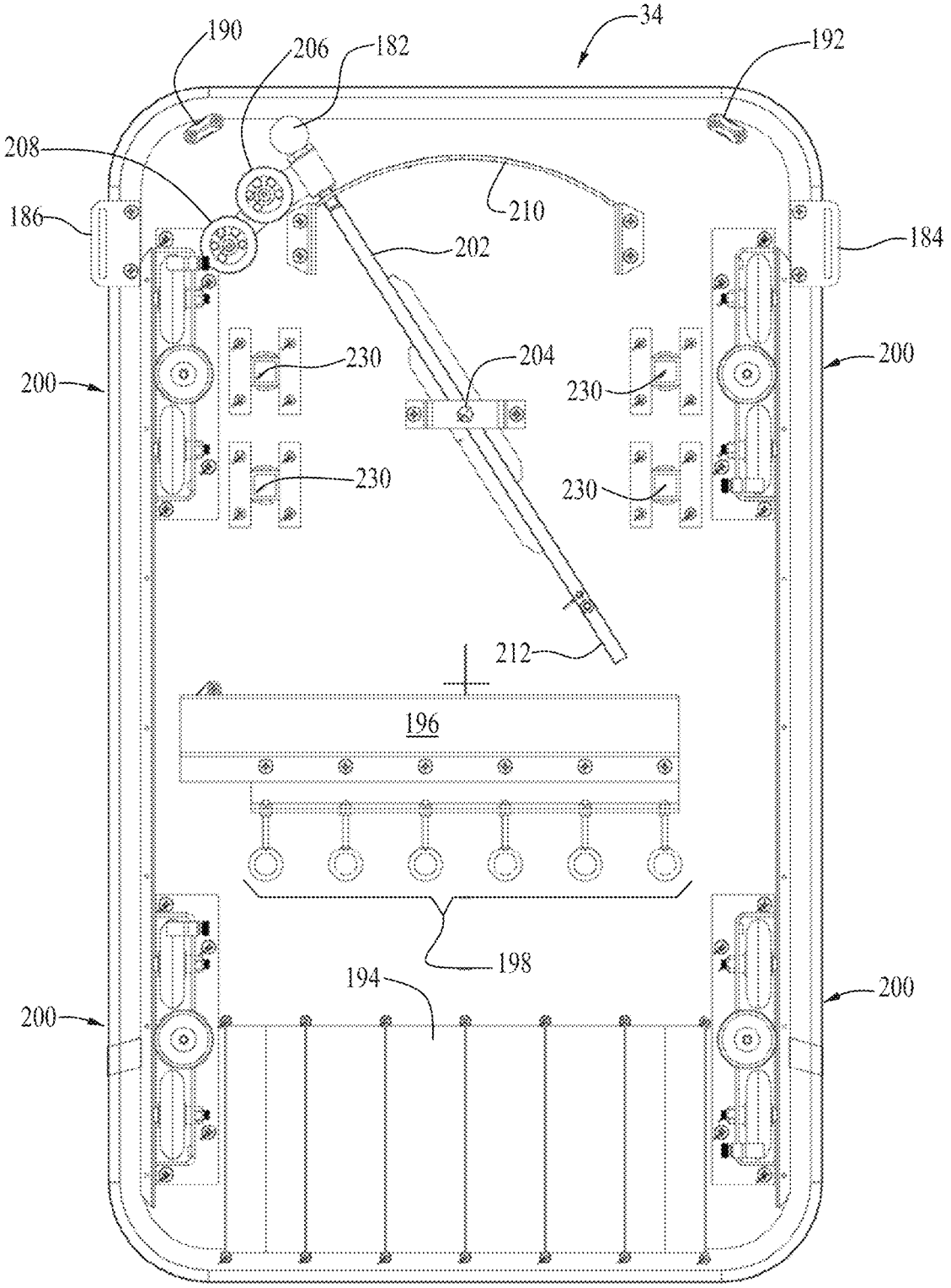
FIG. 24 is a bottom view of the translating platform in a first adjustment configuration.

FIGS. 18, 19, and 24 show the rope equalizing mechanism (156) located on the carriage underside (94). In FIG. 18, a first adjustment configuration is illustrated; and in FIG. 19, a second adjustment configuration is illustrated. The rope equalizing mechanism (156) primarily comprises an equalizing arm (202) which rotates about arm pivot (204), a curved adjustment plate (210), a pull pin (182) attached to the end of the equalizing arm (202), a pair of adjustment sheaves (202, 206) also at the end of the equalizing arm (202), and a series of rope engagement holes at the opposite end of the equalizing arm (202). In the illustrated example embodiment, holes (211, 211', 211", 211'") are formed through the curved adjustment plate (210), which selectively receive the pin of the pull pin (182) to lock the angular position of the equalizing arm (202). Several low-friction plastic deck eyes (188, 190, 192) are located in various positons (as will be described further below) to guide the ropes connected to the rope equalizing mechanism (156).

The carriage underside (94) further includes a spring anchor bracket (196) with a series of aligned eye bolts (198), each holding the fixed ends of the resistance springs (102). The resistance springs (102) are each supported within a spring tube (194), which prevents the springs (102) from falling down, yet permits the springs (102) to expand and contract freely. A parallel series of spring tubes (194) are created by pleating a single sheet of rubber or similar material to create arched tunnels, much like the continuous cartridge pleat known in the art of fabric sewing.

Figure 20:
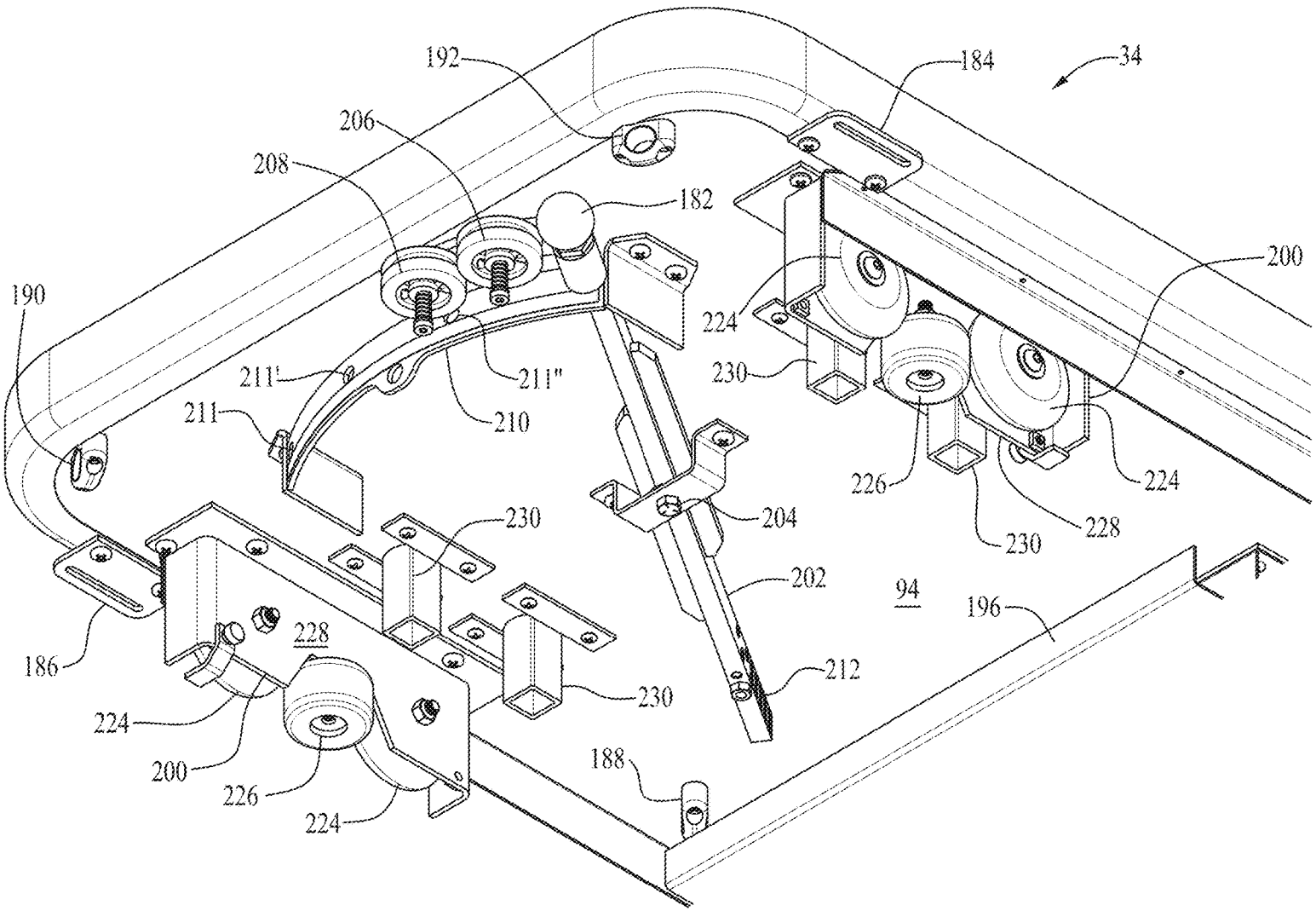
FIG. 20 is a magnified bottom perspective view of the translating platform of FIG. 19 in the second adjustment configuration.

FIG. 20 is a magnified partial view of FIG. 19, showing in greater focus the rope equalizing mechanism (156) and wheel assemblies (200). The ropes have been excluded from FIG. 20 for clarity; however, FIGS. 26 and 32 include schematics of the ropes and their attachment and relationship to the rope equalizing mechanism (156). A first rope (232) and a second rope (234) run parallel and together through the rope equalizing mechanism (156). The first rope (232) and the second rope (234) attach to the equalizing arm (202) by intertwining both ropes within the rope engagement holes (212) for a frictional engagement, much like a straight stich or running stitch in the sewing arts, where the ropes are stitched through the series of holes (212). The first rope (232) and the second rope (234) may be untwined and entwined again to the rope engagement holes (212) to change the length of the ropes. The first rope (232) and the second rope (234) lead from the rope engagement holes (212), through deck eye (188), then through deck eye (190).

The third rope (236) is connected to sheave (208); and the fourth rope (238) is connected to sheave (206). The third rope (236) and the fourth rope (238) run parallel and together through the rope equalizing mechanism (156). The third rope (236) and the fourth rope (238) lead from sheaves (208 and 206), through bracket rope hole (240) (shown in FIG. 18), then through deck eye (192). As will be explained in greater detail in reference to FIGS. 29A-C, the length of the third rope (236) and the fourth rope (238) may be shortened or lengthened by wrapping the ropes about their respective sheaves, enabling a fine adjustment of the ropes to compensate for uneven rope stretching.

Looking still at FIG. 20, if the pull pin (182) were to be pulled out of hole (211'") and the equalizing arm (202) rotated about the pivot (204) counterclockwise, for example, to hole (211), it can be seen that the third rope (236) and the fourth rope (238) would be pulled with sheaves (206, 208) towards hole (211) (or to the viewer's left); and the first rope (232) and the second rope (234) would be pulled away from deck eye (188) (or to the viewer's right). This would effectively shorten the length of all four ropes (232, 234, 236, 238) equally and simultaneously. Movement of the pull pin (182) from hole (211) towards either hole (211', 211", or 211'") will cause the length of all four ropes (232, 234, 236, 238) to lengthen equally and simultaneously.

Figure 27:
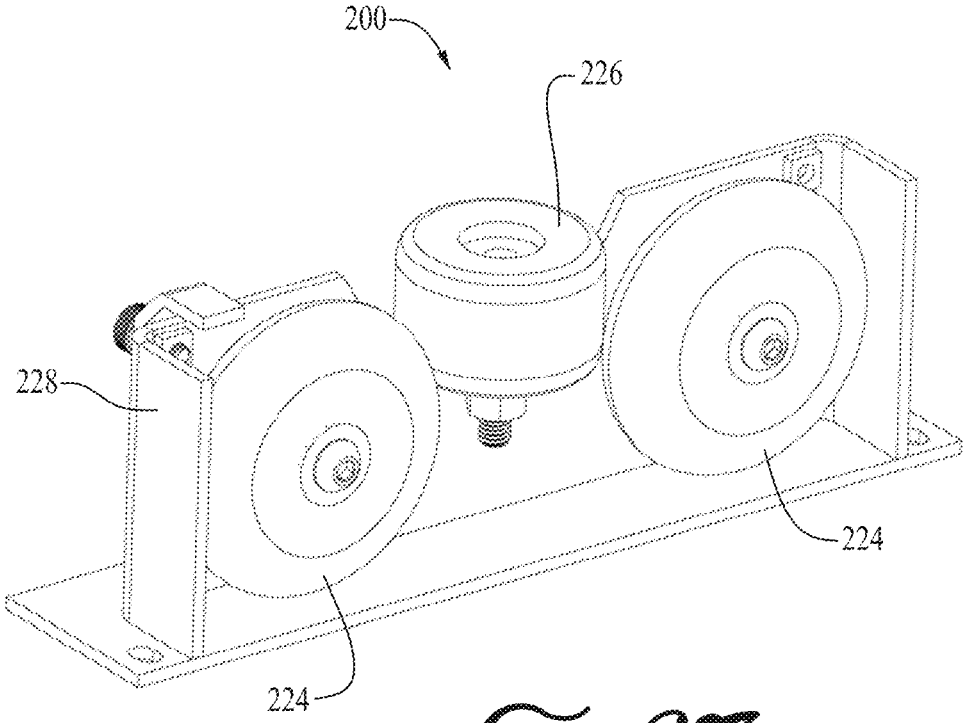
FIG. 27 is a perspective view of the wheel assembly, shown in isolation from the carriage and the remainder of the exercise device.

As shown in FIGS. 20 and 27, four wheel assemblies (200) are attached to the carriage underside (94), and are generally comprised of a wheel bracket (228) which holds two vertically oriented wheels (224) and one horizontally oriented wheel (226). The vertical wheels (224) support the weight of the carriage (34) and the user atop the carriage (34), as the vertical wheels (224) roll on the rails (60 or 62). The horizontal wheel (226) guides the carriage (34) by contacting the side of the rails (60 or 62) to insure the carriage (34) travels in a straight line or in alignment with the rails (60, 62).

Figure 21:
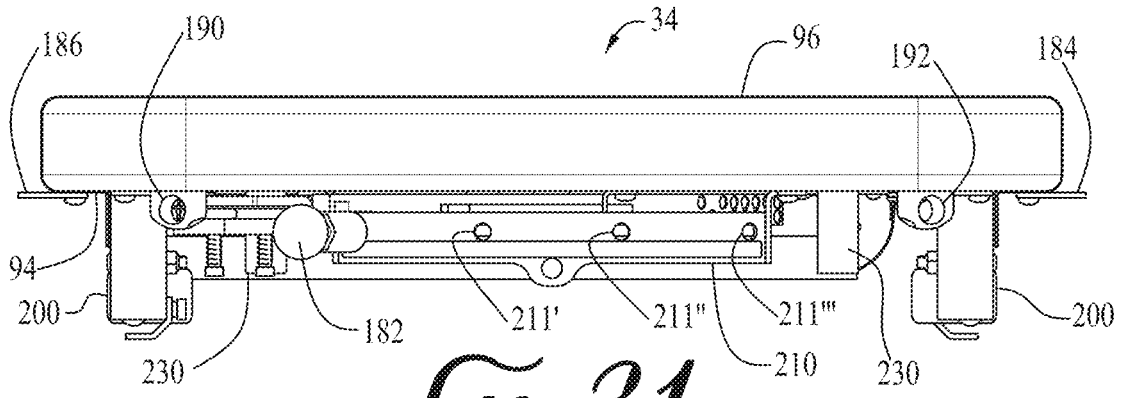
FIG. 21 is a back view of the translating platform in a first adjustment configuration.

The shoulder rest sockets (78, 78', 80, 80') are formed through the carriage (34), from the carriage top side (96) to the underside (94), with shoulder rest guide tubes (230) aligned with the shoulder rest sockets (78, 78', 80, 80') and extending downward from the underside (94). The shoulder rest guide tubes (230) have a square cross-section and receive the square rods (151 and 153) of the shoulder rests (48, 50). The square engagement prevents the rotation of the shoulder rests (48, 50), while the length of the shoulder rest guide tubes (230) prevent tilting. Thus, in order to remove the shoulder rests (48, 50) from the shoulder rest sockets (78, 78', 80, 80'), the user must lift the shoulder rests (48, 50) straight up and out of the sockets (78, 78', 80, 80'). A strap anchor (184) is also located on two edges of the carriage underside (94). FIG. 21 shows a front view of the carriage (34), with a portion of the rope equalizing mechanism (156) visible.

Figure 23:
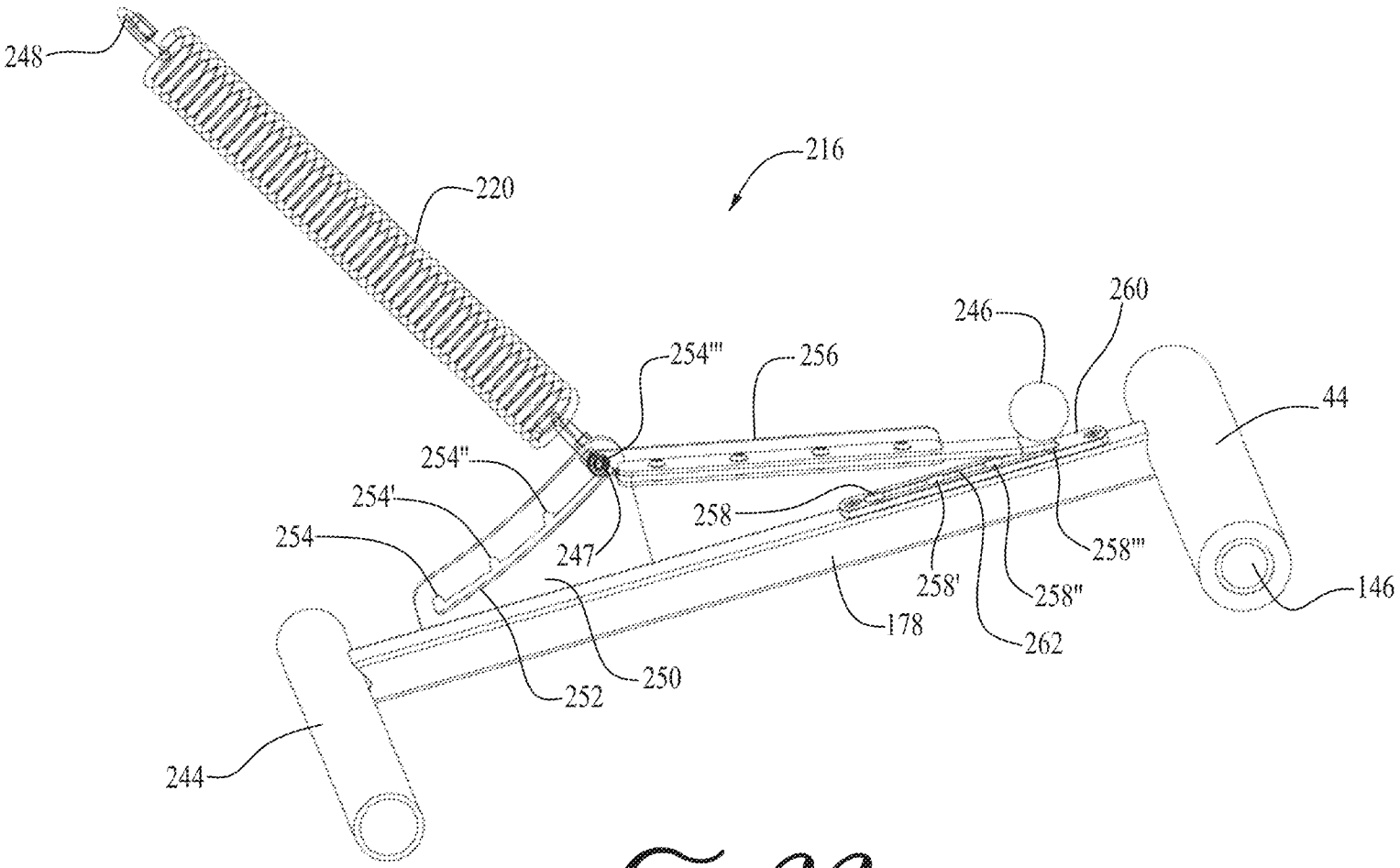
FIG. 23 is a perspective view of one side of the pedal mechanism, isolated from the remainder of the exercise device.

FIG. 23 shows the one side of the pedal assembly (216) isolated from the remainder of the exercise device (30). Sleeve (244) rotates about the pedal axle (72). Pedal arm (178) is welded to the outer diameter of the sleeve (244) and has the pedal (44) welded to the opposite end. An adjustment plate (250) extends from the pedal arm (178), like a fin structure, and has a slot (252) with a series of transverse adjustment notches (254, 254', 254", 254'"). A set plate (260) is attached to a wall of the pedal arm (178). A narrow slot (262) is formed through the set plate (260) and the wall of the pedal arm (178) beneath. A series of spaced set holes (258, 258', 258", 258'") are drilled through the narrow slot (262), and have a diameter larger than the width of the slot (262). The pin of the pull pin (246) normally rests within one of the set holes (258, 258', 258", 258'").

When pull pin (246) is pulled up, a narrow portion of the pin aligns with one of the set hole (258, 258', 258", 258'"), and is narrow enough to permit travel of the pin along the narrow slot (262). And once the pull pin (246) is released, the larger diameter portion of the pin is permitted to reengage with any one of the set holes (258, 258', 258", 258'") selected by the user. Thus, the pull pin (246) may lock in any chosen set hole (258, 258', 258", 258'"). The pull pin (246) is attached to one end of the adjustment arm (256). A spring hook (247) hooks through an opening at the opposite end of the adjustment arm. The spring hook (247) travels in slot (252) on the adjustment plate (250). As the pull pin (246) is repositioned from one set hole to another, the pin must also follow, by changing engagement from one adjustment notch to another. For example, if the pull pin (246) is engaged with hole (258), the spring hook (247) must be engaged with notch (254). If the pull pin (246) is moved to hole (258'), then the spring hook (247) also moves to notch (254'), and so on. The opposite end (248) of the spring (220) attaches to the frame. Thus, as the user changes the pull pin (246) position, the lever arm is changed to adjust the resistance level provided by the spring (220), where hole (258) is the lowest setting and hole (258'") is the highest setting.

Figure 25:
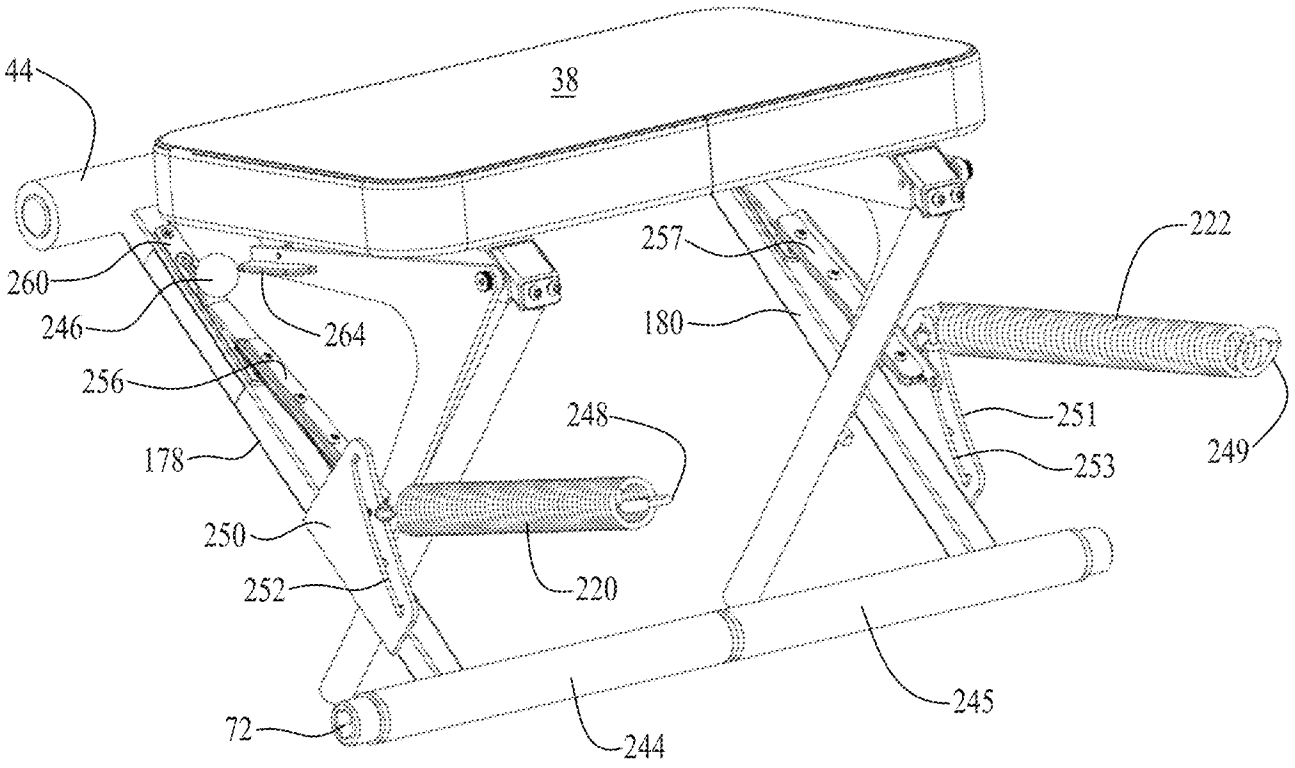
FIG. 25 is back perspective view of the pedal and seat mechanism, shown in isolation from the remainder of the exercise device.
Figure 20:
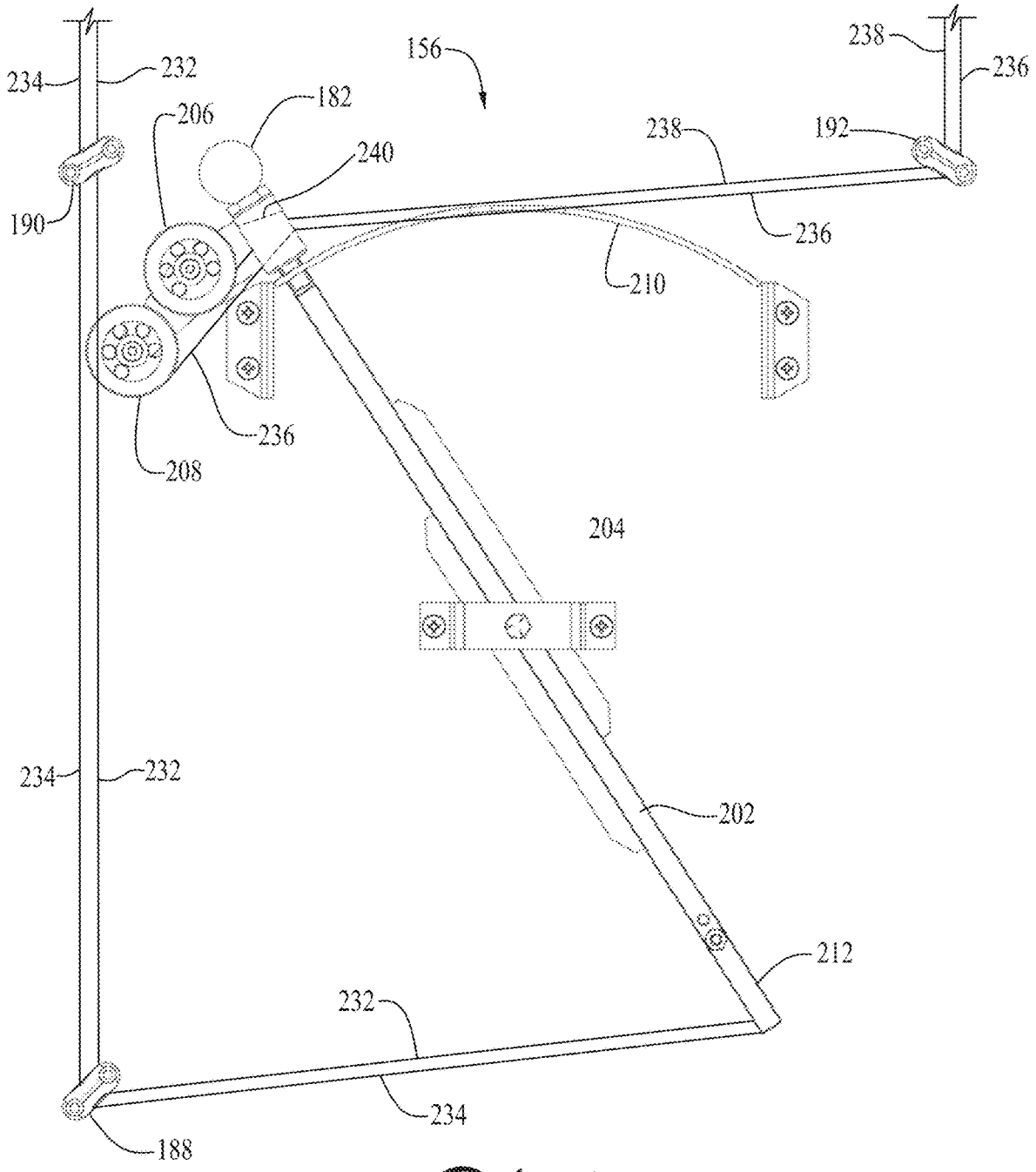

FIG. 25 illustrates both sides of the pedal assembly (216) assembled and isolated from the remainder of the exercise machine (30). Sleeves (244, 245) slip over and rotate about the pedal axle (72). Much like the half of the pedal assembly (216) described in reference to FIG. 23, the remaining half is comprised of a pedal arm (180), an adjustment plate (251) with slot (253), an adjustment arm (257), and a pull pin (247). Spring ends (248, 249) attach to eye bolts anchored to the frame.

Figure 33:
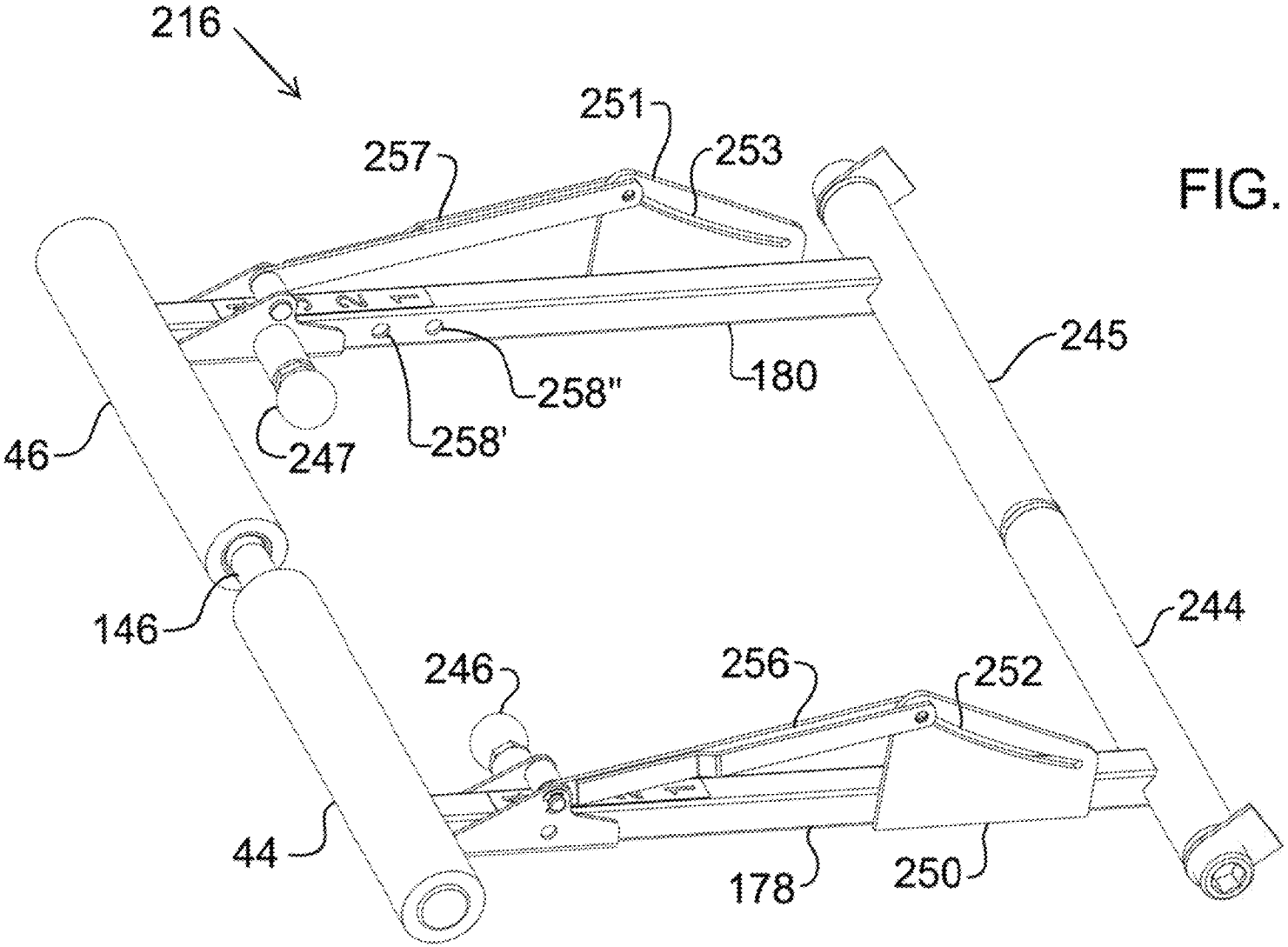
FIG. 33 is a perspective view an alternate embodiment the pedal mechanism, isolated from the remainder of the exercise device.

An alternate embodiment of the pedal assembly (216) is shown in FIG. 33, where the method of adjusting the pedal resistance is slightly modified. The set holes (258, 258', 258") are located on the inner side of each pedal arm (178, 180). Further, there are no notches cut into the arced slot (252, 253) of the adjustment plates (250, 251). To change pedal resistance, the user disengages one or both pull pins (246, 247) from one of the set holes (258, 258', 258"), locating to another set hole.

As mentioned above, ropes (236 and 238) wrap respectively about sheaves (208 and 206). As detailed in FIGS. 29A-C, the sheave adjustment mechanism (283) allows the user to turn and lock the sheave to control the length of rope wrapped about the sheave. Looking first at FIGS. 29A and 29B, the sheave (208) has a hexagonal opening (296), a circular array of rope threading holes (294), and a rope inlet (293) formed radially and intersecting one of the rope threading holes (294). A hex coupling nut (286) is fastened to the sheave bracket (290) by welding or other similar means. The hex coupling nut (286) is configured to be inserted into the hexagonal opening (296) with a sliding fit, yet prevents rotation of the sheave (208) when inserted. The shoulder screw (285) is inserted through spring (289) and threaded into hex coupling nut (286).

In this way, the sheave (208) is biased into locking engagement with the hex coupling nut (286). To turn the sheave (208) relative to the sheave bracket (290), the user must axially pull the sheave (206) towards the screw head (298) against the spring (289) bias to disengage the hex opening (296) from the hex coupling nut (286), as indicated by the arrows in FIG. 29A. Once the sheave (208) is above the hex coupling nut (286), the sheave may be freely rotated. When the user releases the sheave (208), the spring (289) will force the hex opening (296) back into engagement with the hex coupling nut (286).

The rope (236) is connected to the sheave (208) by threading the rope (236) into the rope inlet (293), then weaving the rope (236) through one or more rope threading holes (294), much like a straight stich or running stitch in the sewing arts. A knot may be tied at the end of the rope (236), but is not preferred, since simply stitching the rope (236) through successive rope threading holes (294) provides sufficient holding strength through friction, and may be quickly unthreaded to further adjust the length of the rope (236).

The sheave adjustment mechanism (283) permits fine adjustment of the length of the rope (236) to compensate for uneven stretching between pairs of ropes (i.e., between rope pair 236-234 and between rope pair 238-232). Once the rope (236) is threaded to the sheave (208), the user lifts the sheave (208) and rotates the sheave (208) to further wrap or unwrap the rope (236) about the sheave (208) within annular groove (300). Once released, the sheave's (208) rotation is locked by engagement with the hex coupling nut (286). Sheave (206) may be similarly adjusted with the rope (238) inserted into rope inlet (292), by pulling the sheave (206) against spring (288) on shoulder screw (284).

Figure 30A:
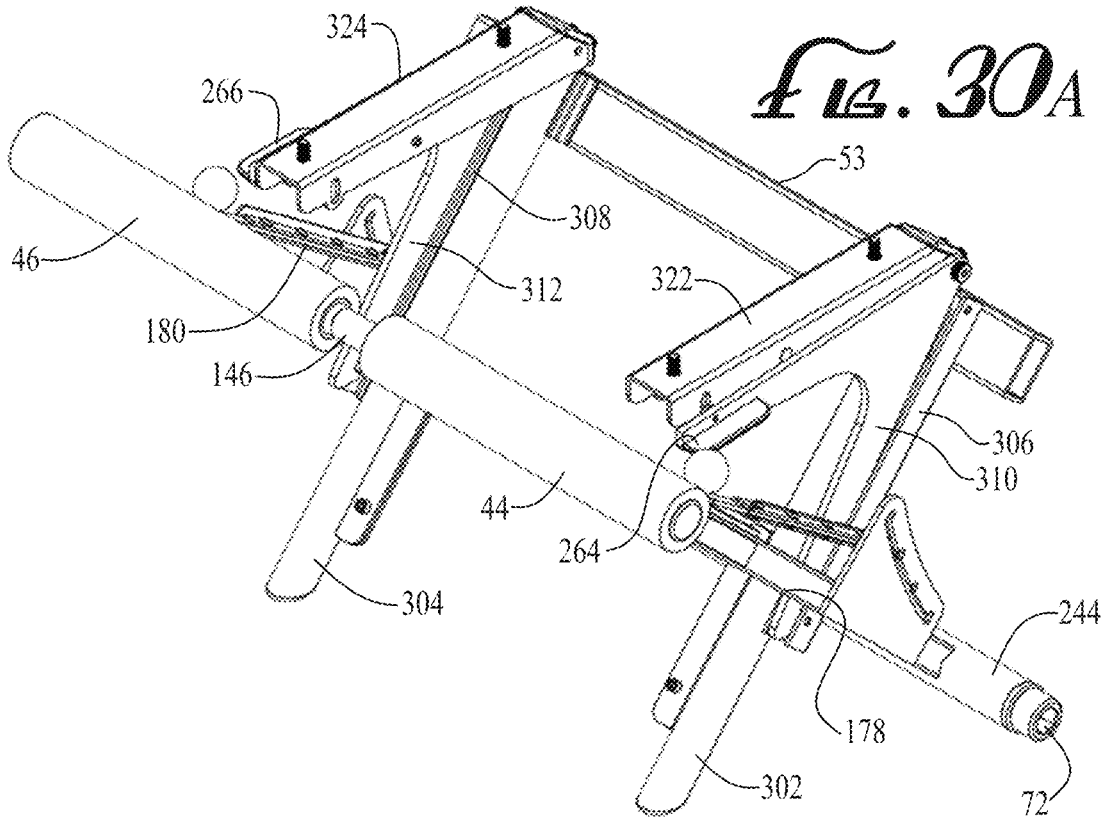
FIG. 30A-C are perspective views of the pedal assembly and seat adjustment assembly, shown from various angles.
Figure 30B:
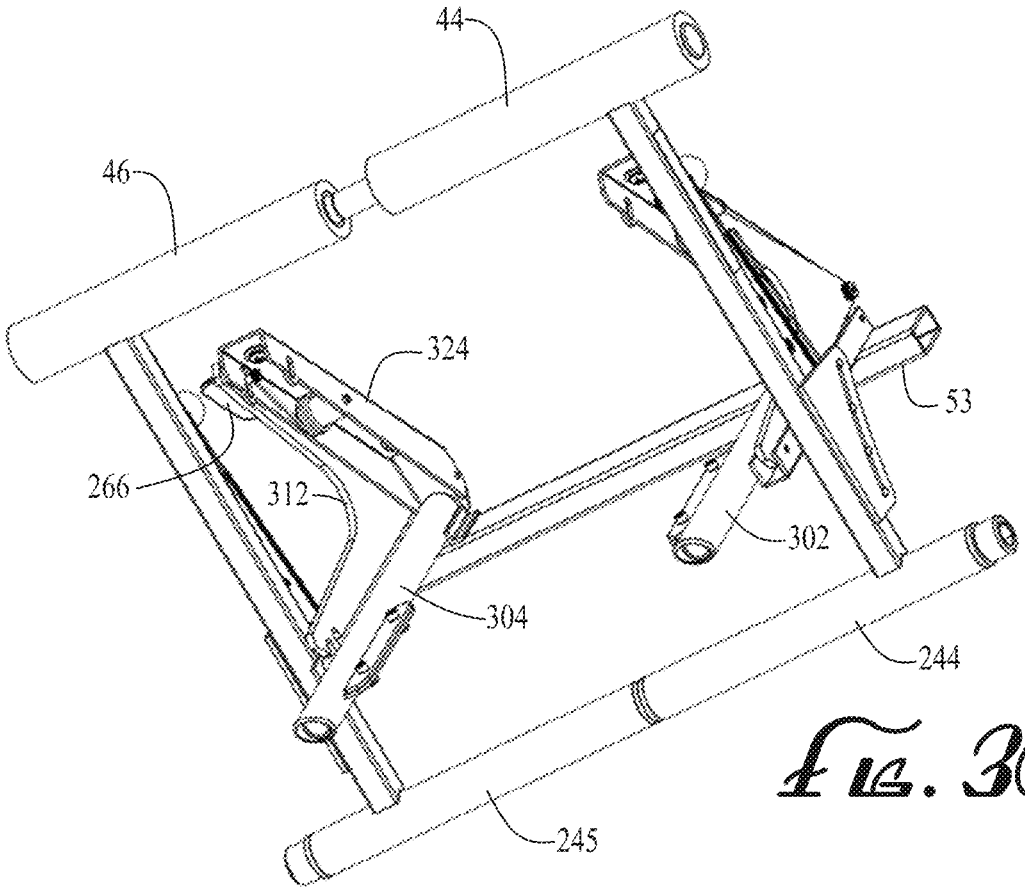
Figure 30C:
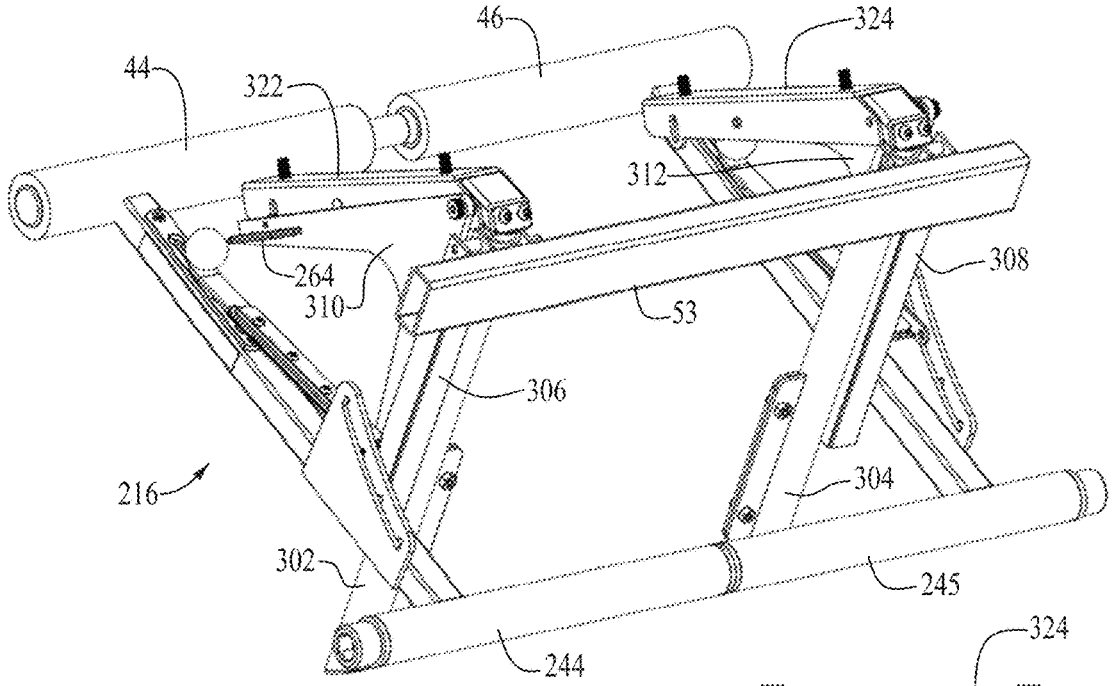
Figure 30D:
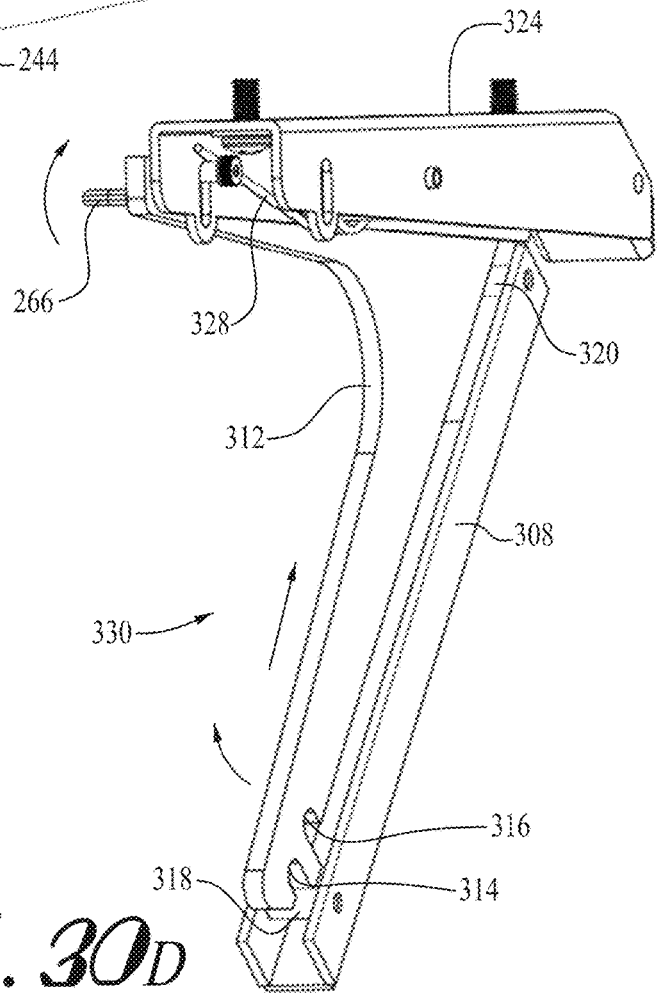
FIG. 30D is a perspective view of the height adjustment bracket of the seat adjustment assembly.

Referring now to FIGS. 30A-C, the seat height adjustment mechanism (330) is illustrated, in isolation in FIG. 30D and with the pedal assembly (216) in FIGS. 30A-C. Looking at FIGS. 30C and 30D in particular, U-channel (308) has a lower pin (318) and an upper pin (320) traversing the channel. The U-channel (308) is attached to leg (304). Seat bracket (324) is attached to the upper portion of telescoping tube (332) (best seen in FIG. 16), where telescoping tube (332) slides within leg (304). Additionally, telescoping tube (334) slides within leg (302). Thus, when seat (38) is lifted, telescoping tubes (332, 334) extend from their respective legs (304, 302). Although not shown, a gas spring or other appropriate lifting assist may be mounted beneath the seat (38) to assist the user in raising and lowering the seat height.

Height adjustment bracket (312) is generally L-shaped, and is pivoted near the L corner to the seat bracket (324). A release lever is pivoted to one leg of the height adjustment bracket (312), and is biased by spring (328). On the second leg of the height adjustment bracket (312) is a lower notch (314) and an upper notch (316). When the seat (38) is in the lowered position, lower notch (314) is engaged with lower pin (318), where spring (328) biases the notch (314) towards pin (318). When the seat (38) is in the raised position, upper notch (316) is engaged with upper pin (320), where spring (328) again biases the notch (316) towards pin (320).

Similarly, the opposing side of the seat adjustment assembly (214) has a U-channel (306), a height adjustment bracket (310) with a release lever (264) and biased by a spring (326), and a seat bracket (322), all similarly arranged as described above. To raise the seat (38), the user must depress both release levers (264 and 266) by grasping the edge of the seat (38) and pulling the release levers (264, 266) upwards with the fingers to release the notch (314) from the pin (318) on both sides. The user will then lift up on the seat (38) until notch (316) engages pin (320). To lower the seat (38), the user similarly depresses both release levers (264, 266), and lower the seat (38) until notch (314) engages pin (318).

Figure 32:
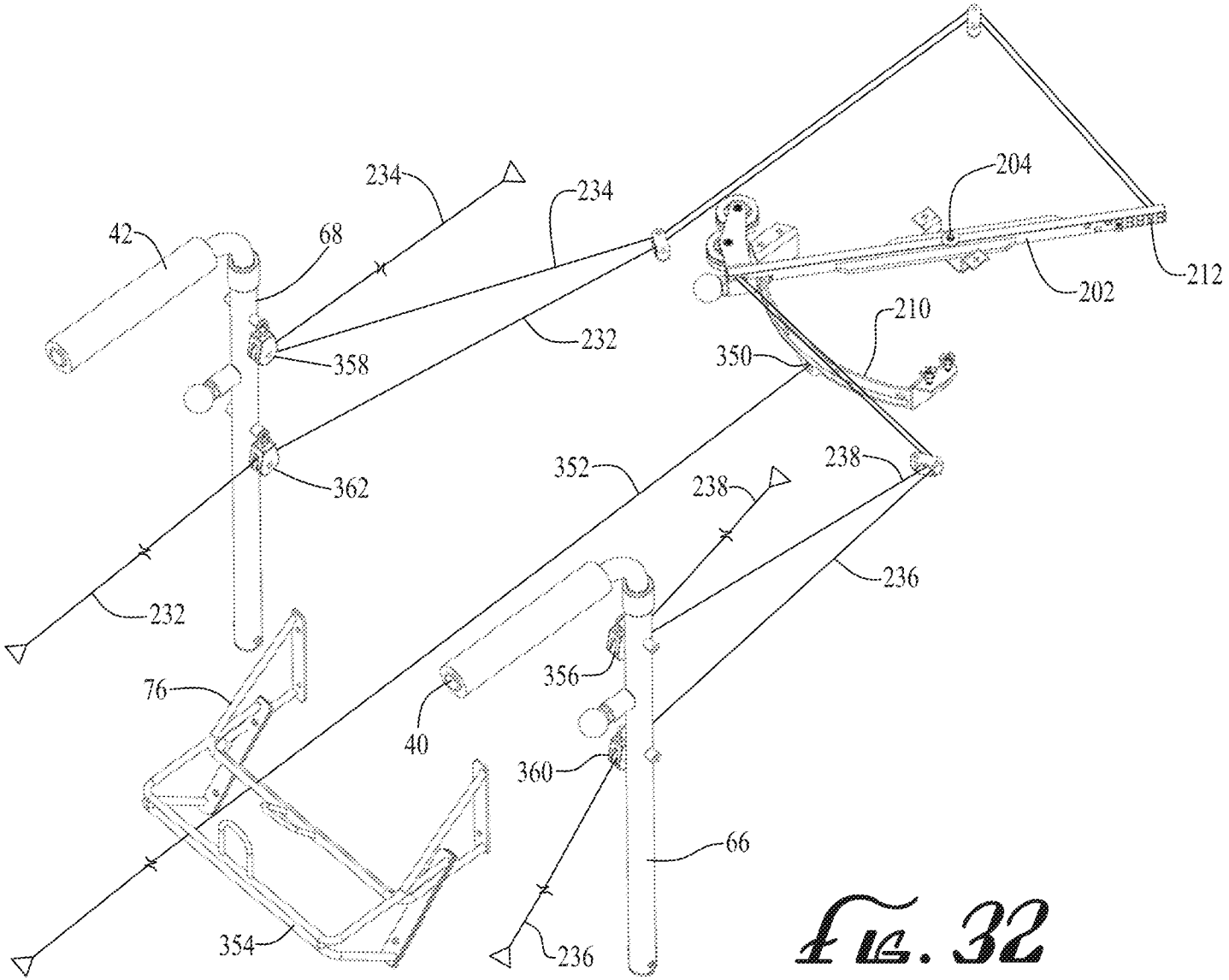
FIG. 32 is a perspective view of rope system shown in isolation from the remainder of the exercise device, with the rope schematically represented.

FIG. 32 illustrates the rope and pulley system, shown in schematic form. At the end of each rope (232, 234, 236, 238) is a device for holding or grasping the rope as the user tensions the rope, such as a handle, strap, or other similar means. Many of the parts of the present exercise device (30) have been removed in FIG. 32, leaving the cord equalizing system (156), the handles (40, 42), the handle bar posts (66, 68), and the rope guide (76). Ropes (234 and 238) extend from opposing sides of the cord equalizing system (156) from under the carriage. Ropes (234 and 238) extend through upper pulleys (358 and 356) respectively. A handle is shown schematically at the end of each rope (234, 238). Ropes (232 and 236) extend from opposing sides of the cord equalizing system (156) from under the carriage. Ropes (232 and 236) extend through lower pulleys (362 and 360) respectively. A handle is shown schematically at the end of each rope (232, 236). Additionally, a center rope (352) is connected to center rope attachment hole (350) of the adjustment plate (210). Center rope (352) extends to rope guide (76). The rope guide (76) is constructed of thick bent wire configured to create two rope guide slots (354) between two sets of parallel wires. The rope guide slots (354) keep the center rope (352) from traveling too far to one side or another.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

What is claimed is:

1. An exercise machine, comprising:

a frame having two frame members parallel to and connected by a cross member with one another, the two frame members each having a rail upon which a translating carriage rolls between a front end and a back end of the frame;

a plurality of resistance springs connected between the frame and the translating carriage to bias the translating carriage toward the front end of the frame when connected;

a seat mechanism coupled with the frame and comprising a seat, a bracket supporting the seat, and a height adjustment system, activation of the height adjustment system permits selective adjustment and locking of the height of the seat relative to the translating carriage; and a pedal mechanism coupled with the frame and comprising an axle, a pedal arm extending from and rotating about the axle, and a pedal at a distal end of the pedal arm;

a pedal resistance mechanism coupled to the pedal mechanism and comprising an adjustment slot having a plurality of adjustment stops, an arced slot, an adjustment arm having a first end slidable within the adjustment slot and a second end slidable within the arced slot, and a resistance source coupled with the second end, such that manual movement of the first end of the adjustment arm within the adjustment slot changes the resistance provided to the pedals from the resistance source and causes the second end of the adjustment arm to travel within the arced slot with the resistance source following.

* * * * *